US007715615B2

(12) United States Patent
Van Nice et al.

(10) Patent No.: US 7,715,615 B2
(45) **Date of Patent: *May 11, 2010**

(54) SEPARATOR SHEET HANDLING ASSEMBLY

(75) Inventors: Jeff G. Van Nice, Beaver Dam, WI (US); Dennis A. VanderHoeven, Beaver Dam, WI (US); Brian E. Busse, Madison, WI (US)

(73) Assignee: Busse/SJI Corporation, Randolph, WI (US)

( * ) Notice: Subject to any disclaimer, the term of this patent is extended or adjusted under 35 U.S.C. 154(b) by 1329 days.

This patent is subject to a terminal disclaimer.

(21) Appl. No.: 11/065,817

(22) Filed: Feb. 25, 2005

(65) Prior Publication Data

US 2005/0212200 A1 Sep. 29, 2005

Related U.S. Application Data

(63) Continuation-in-part of application No. 10/030,853, filed on Jan. 11, 2002, now Pat. No. 6,910,687.

(60) Provisional application No. 60/548,319, filed on Feb. 27, 2004.

(51) Int. Cl.
*G06K 9/00* (2006.01)

(52) U.S. Cl. ..... 382/149; 209/549; 271/98; 382/152

(58) Field of Classification Search ..... 209/549, 209/599; 250/559.36; 271/98, 209; 377/8; 382/145, 149, 152
See application file for complete search history.

(56) References Cited

U.S. PATENT DOCUMENTS

| | | | |
|---|---|---|---|
| 3,355,008 | A | 11/1967 | Milazzo |
| 3,717,249 | A | 2/1973 | Faley |
| 3,812,964 | A | 5/1974 | Woodruff |
| 3,934,707 | A | 1/1976 | Bowman |
| 4,003,567 | A | 1/1977 | Berger et al. |
| 4,148,473 | A | 4/1979 | Johnson |
| 4,180,258 | A | 12/1979 | Wildforster |
| 4,189,136 | A | 2/1980 | Robinette |
| 4,210,320 | A | 7/1980 | Feldkamper |
| 4,211,398 | A | 7/1980 | Bishop |
| 4,245,830 | A | 1/1981 | Fichte et al. |
| 4,470,589 | A | 9/1984 | Singer |
| 4,511,030 | A | 4/1985 | Lem |
| 4,724,481 | A | 2/1988 | Nishioka |
| 4,765,606 | A | 8/1988 | Marass |

(Continued)

FOREIGN PATENT DOCUMENTS

| | | |
|---|---|---|
| WO | WO 01/04025 A2 | 1/2001 |

OTHER PUBLICATIONS

DVT Corporation, New Standards In High-Performance Vision, Legend Series, 2002.

*Primary Examiner*—Gregory M Desire
(74) *Attorney, Agent, or Firm*—Boyle Fredrickson, S.C.

(57) ABSTRACT

A test assembly is used to determine a characteristic of a separator sheet. The test assembly includes a source of light to illuminate at least a portion of the separator sheet. The test assembly also includes a vision inspection system to record at least one discrete image of the illuminated surface of the separator sheet and apply at least one test to the discrete image to determine the characteristic of the separator sheet.

39 Claims, 24 Drawing Sheets

U.S. PATENT DOCUMENTS 4,768,913 A 9/1988 Baba
5,115,144 A 5/1992 Konishi et al.
5,132,791 A 7/1992 Wertz et al.
5,235,883 A 8/1993 Jeske et al.
5,441,252 A * 8/1995 Hommes ..... 271/290
5,842,577 A 12/1998 Stevens et al.
5,847,405 A * 12/1998 Acquaviva et al. ..... 250/559.36
5,903,954 A 5/1999 Gajewski
5,979,891 A 11/1999 Roux
6,080,242 A 6/2000 Gajewski
6,082,732 A 7/2000 Hutchinson et al.
6,137,855 A * 10/2000 Hill et al. ..... 377/8
6,369,882 B1 4/2002 Bruner et al.
6,398,461 B1 6/2002 Vincent et al.
6,874,777 B2 * 4/2005 Sano et al. ..... 271/109
6,880,952 B2 4/2005 Kiraly et al.
6,910,687 B1 * 6/2005 Van Nice et al. ..... 271/98
2004/0251176 A1 12/2004 Alonso et al.
2005/0129892 A1 * 6/2005 Beyer ..... 428/40.1

* cited by examiner

SEPARATOR SHEET HANDLING ASSEMBLY

CROSS-REFERENCE TO RELATED APPLICATION

This application claims priority from U.S. Provisional Patent Application No. 60/548,319, entitled "Separator Sheet Handling Assembly", filed Feb. 27, 2004 by Jeff G. Van Nice, Dennis A. VanderHoeven, and Brian E. Busse. This application is also a continuation-in-part of U.S. patent application Ser. No. 10/030,853, entitled "Separator Sheet Handling Assembly", filed Jan. 11, 2002 now U.S. Pat. No. 6,910,687, by Jeff G. Van Nice, Dennis A. VanderHoeven, and Brian E. Busse.

BACKGROUND

The present invention relates generally to an assembly for handling separator sheets, and more particularly to an assembly that sorts a pile of separator sheets, which are used in stacking multiple layers of products onto pallets, into different piles depending on the characteristics of the individual separator sheets.

Smaller products or articles of production (e.g., beverage containers) are commonly stacked onto pallets for shipping and handling. The products are arranged in horizontal tiers, or layers, on the pallet such that additional layers can be stacked on top of the lower layers. Separator sheets are placed between the layers of products to provide a uniform support surface for each layer of products. The uniform support surface makes adding and removing the top layer of products easier. As the top layers of products are unstacked from the pallet, the separator sheets between each layer are removed and set aside for reuse.

Depending on the types of products that are stacked onto the pallet, and the environment where the stacking process takes place, the separator sheets may become dirty and/or damaged. Using a dirty or damaged separator sheet in order to facilitate stacking products into layers on a pallet can result in (i) the products becoming damaged or dirty, (ii) the products being stacked on to the pallet unsafely, and (iii) damage to the palletizing machine that stacks the products onto the pallet.

SUMMARY

In one embodiment, the invention provides a test assembly adapted to determine a characteristic of a separator sheet. The test assembly includes a source of light to illuminate at least a portion of a surface of the separator sheet. The test assembly also includes a vision inspection system to record at least one discrete image of the illuminated surface of the separator sheet and apply at least one test to the discrete image to determine the characteristic of the separator sheet.

In another embodiment, the invention provides a test assembly adapted to determine a characteristic of a separator sheet that includes a first test sub-assembly and a second test sub-assembly. The first test sub-assembly monitors a first surface of the separator sheet for a first characteristic. The second test sub-assembly is positioned opposite the first test sub-assembly and monitors a second surface opposite the first surface of the separator sheet for a second characteristic. The second test sub-assembly is movable relative to the first test sub-assembly.

In another embodiment the invention provides a method of testing a separator sheet for a characteristic. The method includes illuminating at least a portion of a surface of the separator sheet, recording a discrete image of the illuminated surface of the separator sheet, and testing the discrete image to determine the characteristic of the separator sheet wherein the discrete image is subdivided into multiple regions.

Other features and advantages of the invention will become apparent to those skilled in the art upon review of the following detailed description and drawings.

Figure 1:
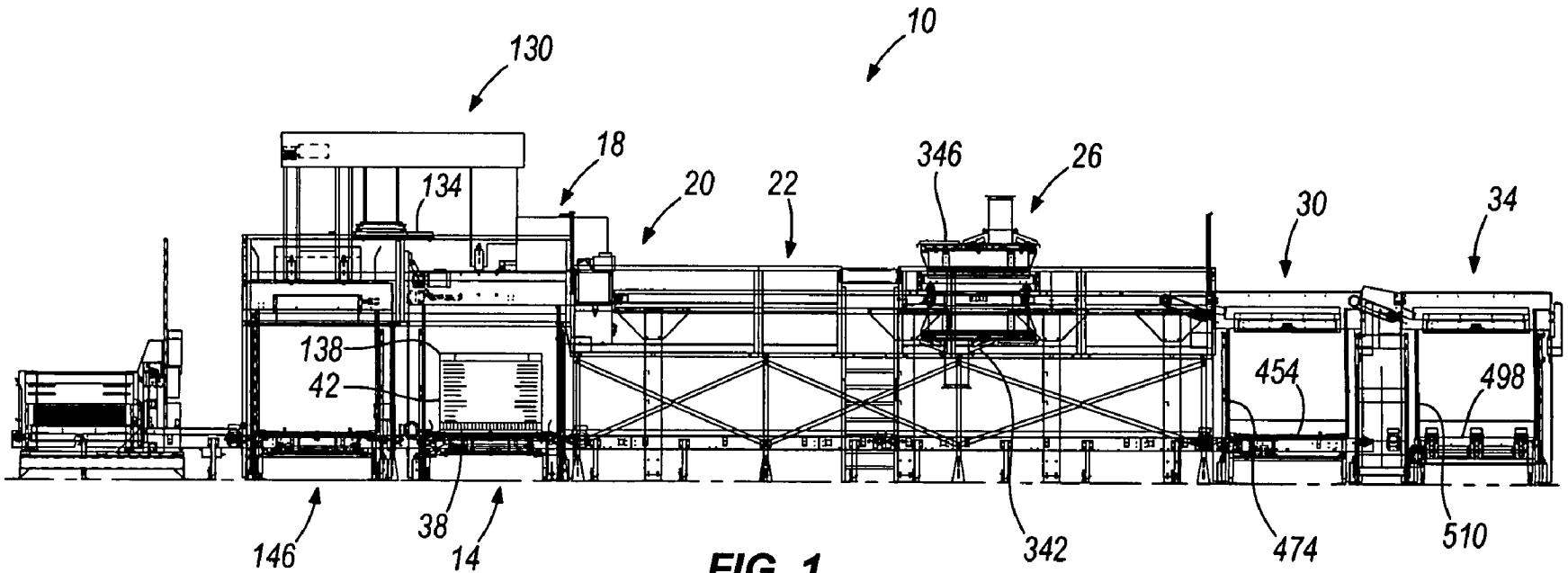
FIG. 1 is a side view of a separator sheet handling assembly embodying the present invention.

Before any features of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including", "having", and "comprising" and variations thereof herein is meant to encompass the items listed thereafter and equivalents thereof as well as additional items. The use of letters to identify elements of a method or process is simply for identification and is not meant to indicate that the elements should be performed in a particular order.

DETAILED DESCRIPTION

Figure 2:
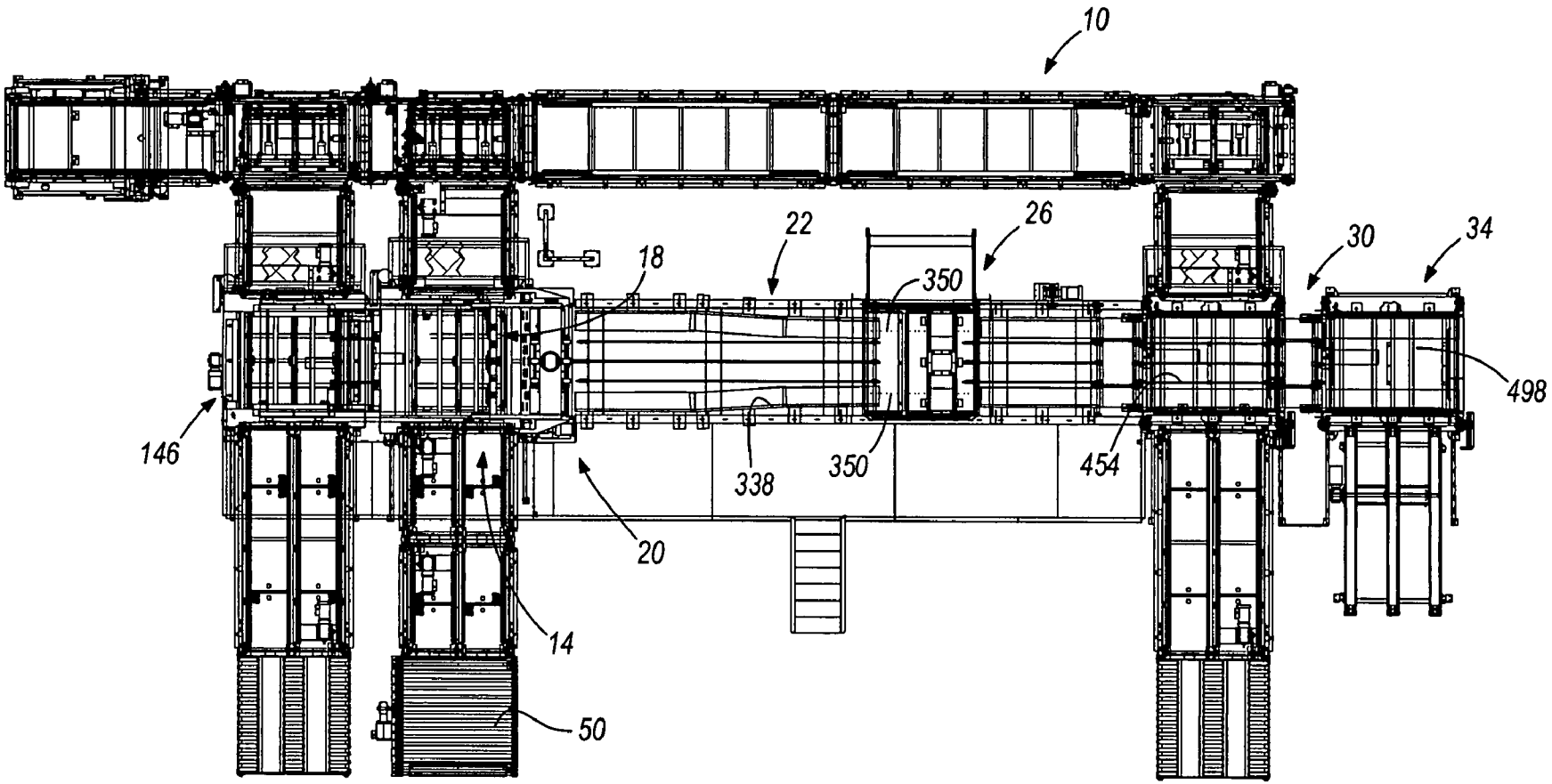
FIG. 2 is a top view of the separator sheet handling assembly shown in FIG. 1.

A separator sheet handling assembly 10 embodying the invention is illustrated in FIGS. 1 and 2. The illustrated separator sheet handling assembly 10 includes a lift assembly 14, a feed assembly 18, and a sheet cleaning assembly 20, an alignment assembly 22, a test assembly 26, a first storage assembly 30, and a second storage assembly 34. A similar separator sheet handling assembly, without the sheet cleaning assembly 20 and the test assembly 26 of the present invention, is shown and described in PCT Publication No. WO 01/04025, the entire contents of which are incorporated herein by reference.

During operation of the separator sheet handling assembly 10, a pallet 38 having a stack of separator sheets 42 thereon is supplied into the lift assembly 14. The lift assembly 14 moves the pallet 38 upward until the feed assembly 18 grasps a separator sheet 46 positioned on top of the stack of separator sheets 42. The feed assembly 18 transports the separator sheet 46 (see FIG. 3*a*) into the alignment assembly 22. As the separator sheet 46 passes through the alignment assembly 22, the separator sheet 46 is maneuvered to a predetermined location for delivery to the test assembly 26. The test assembly 26 is adapted to test the separator sheet 46 in order to determine if the separator sheet 46 is clean and free from holes, tears or any other damage. The separator sheet 46 is preferably tested (and analyzed) as it is transported through the test assembly 26, although the movement of the separator sheet 46 might have to either be slowed, or stopped altogether, depending on types of tests that are performed.

Depending on the condition of the separator sheet 46, it is either transported into the first storage assembly 30 or transported over the first storage assembly 30 into the second storage assembly 34. It should be noted that additional storage assemblies could be added if the test assembly 26 has the capacity to analyze additional characteristics on the separator sheet 46. As an example, clean and undamaged separator sheets 46 would be transported to the first storage assembly 30, dirty but undamaged sheets would be transported into the second storage assembly 34 and damaged sheets would be transported into a third storage assembly (not shown).

In the assembly illustrated in FIGS. 1 and 2, the lift assembly 14 is adapted to receive a pallet 38 that is inserted by a lift truck or other pallet handling device including, but not limited to, a conveyor 50. Although any conventional lift could be employed without departing from the scope of the present invention, the lift assembly 14 is shown as a chain-driven platform 54 that indexes the pallet 38 upward at designated intervals so that the feed assembly 18 removes the separator sheets 46 one at a time from the top of the stack of separator sheets 42. Alternatively, the lift assembly 14 may comprise a scissors lift which is powered by a hydraulic cylinder.

Figure 8:
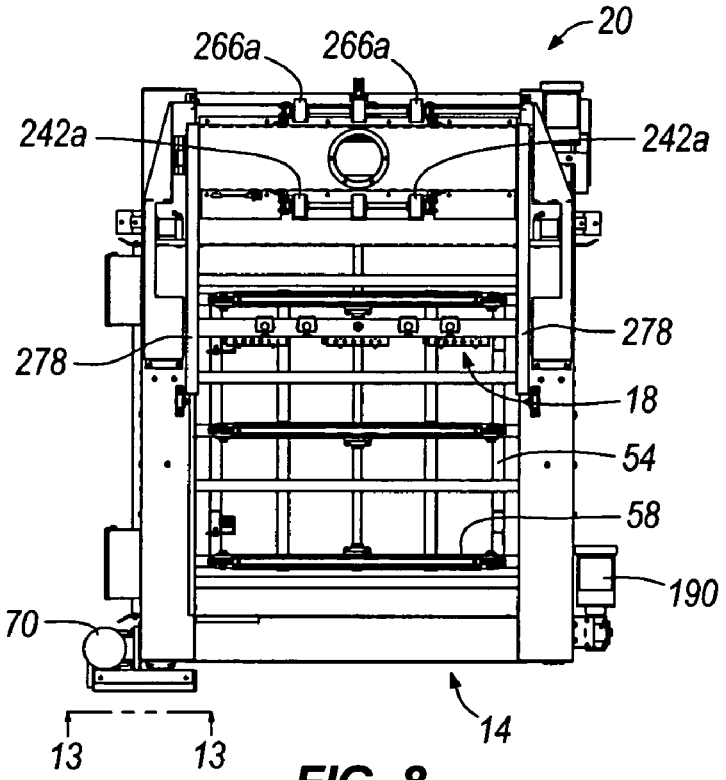
FIG. 8 is an enlarged top view of the lift assembly shown without a stack of separator sheets, the feed assembly, and the sheet cleaning assembly of the separator sheet handling system of FIG. 1.
Figure 9:
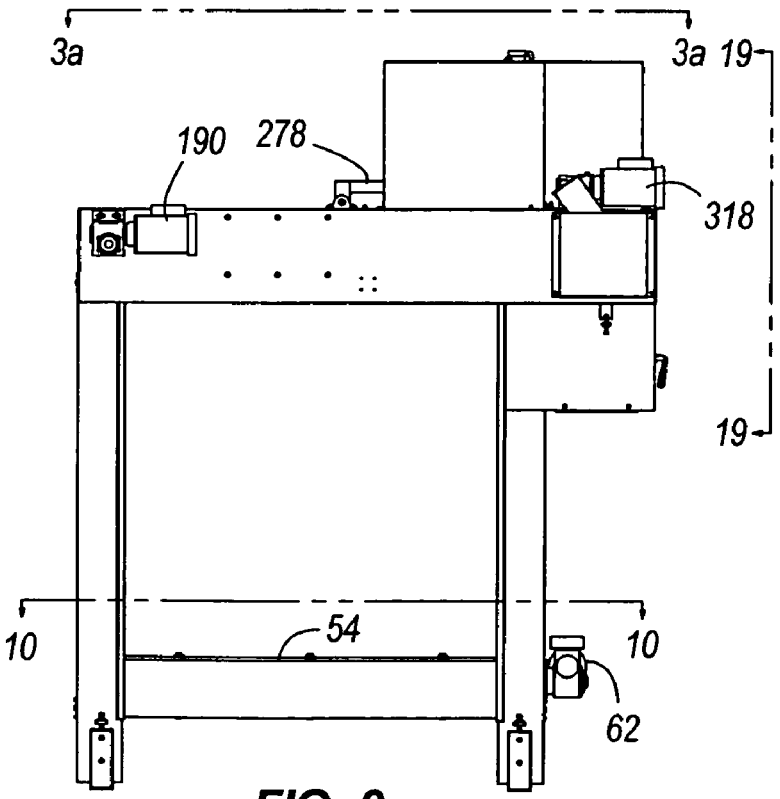
FIG. 9 is a side view of the assemblies, particularly the lift assembly, of FIG. 8.
Figure 11:
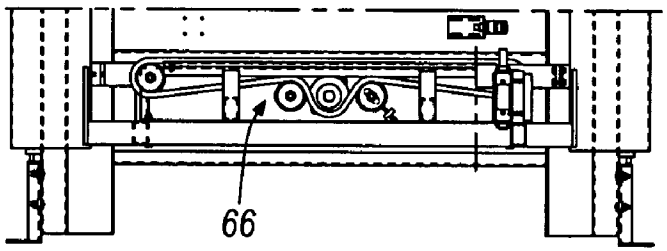
FIG. 11 is a cross-sectional view through line 11-11 of the lift assembly of FIG. 10.
Figure 10:
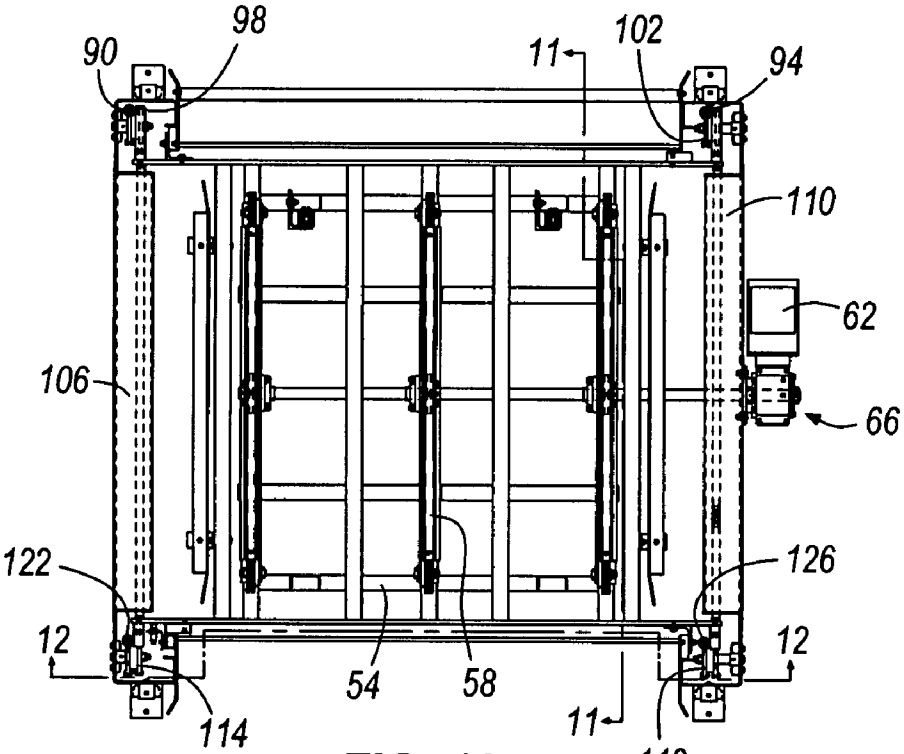
FIG. 10 is a cross-sectional view through line 10-10 of the lift assembly of FIG. 9.

With reference to FIGS. 8 and 9, the platform 54 is shown without a pallet 38 and a stack of separator sheets 42 thereon. The platform 54 incorporates a platform conveyor 58 that is utilized to load the pallets 38 onto the platform from the conveyor 50. FIGS. 10 and 11 illustrate a motor 62 and drivetrain 66 utilized to power the platform conveyor 58.

Figure 12:
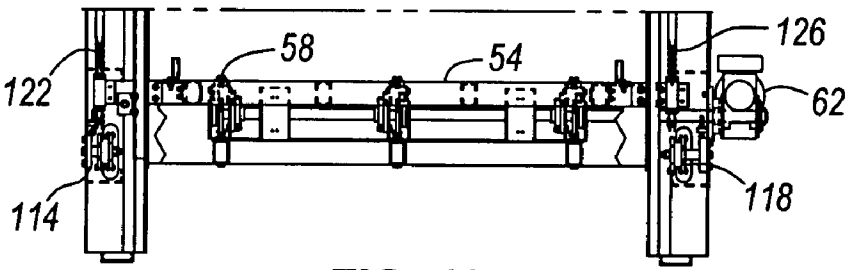
FIG. 12 is a cross-sectional view through line 12-12 of the lift assembly of FIG. 10.
Figure 15:
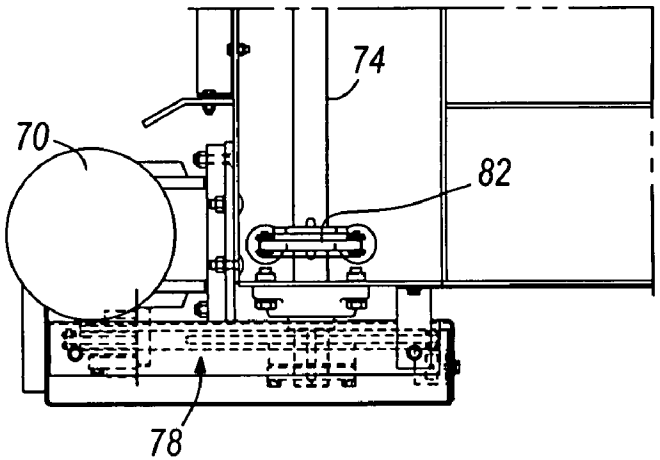
FIG. 15 is a top view of the chain drive mechanism of FIG. 13.
Figure 14:
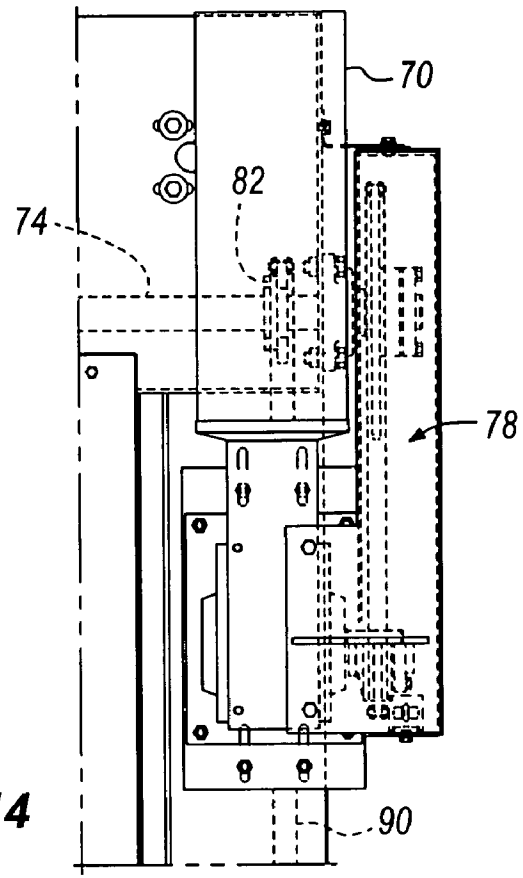
FIG. 14 is a side view of the chain drive mechanism of FIG. 13.
Figure 13:
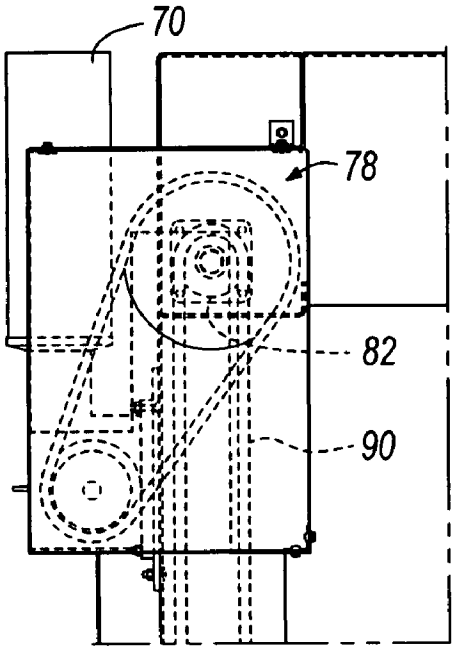
FIG. 13 is an enlarged end view of a chain drive mechanism for the lift assembly of FIG. 8.
Figure 18:
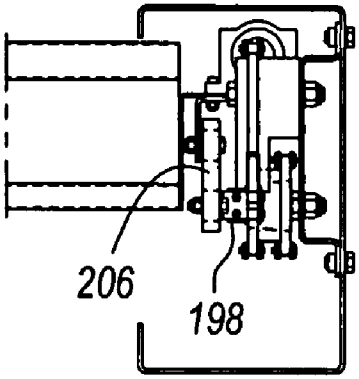
FIG. 18 is an end view of the chain drive mechanism of FIG. 16.
Figure 17:
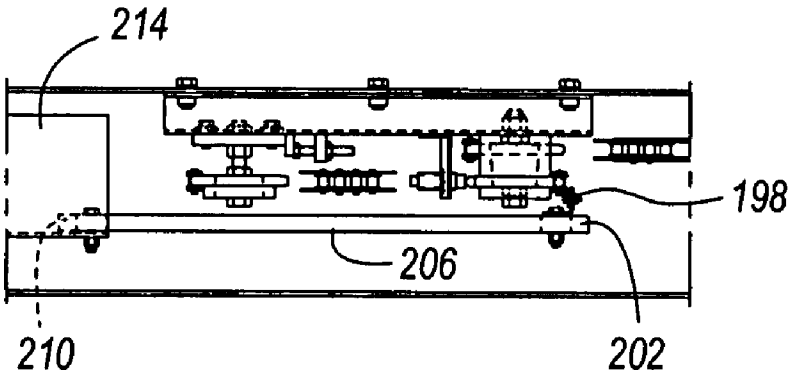
FIG. 17 is a top view of the chain drive mechanism of FIG. 16.
Figure 16:
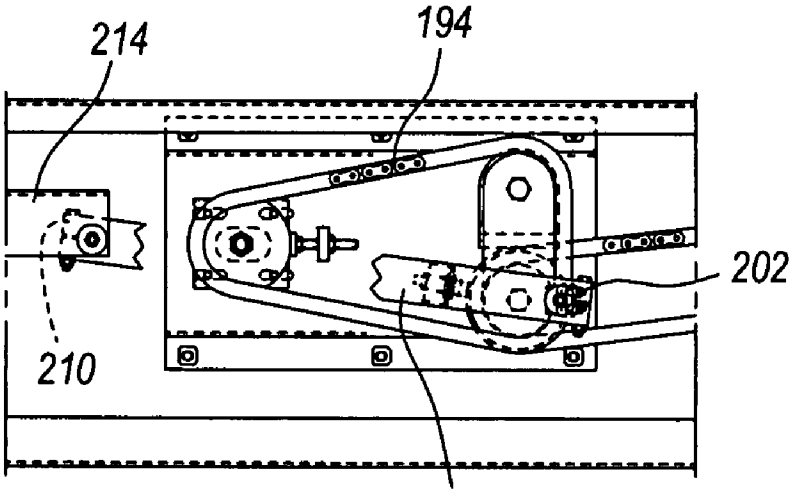
FIG. 16 is an enlarged side view of a chain drive mechanism for the feed assembly of FIG. 3*a*.

With reference to FIGS. 10-12 and 13-15, the chain-drive mechanism utilized to raise and lower the platform 54 is shown. FIGS. 13-15 illustrate a motor 70 drivingly connected to a line shaft 74 (see FIG. 15) via a speed-reducing drivetrain 78. The line shaft 74 extends across the width of the platform 54 and two drive sprockets 82, 86 (see FIG. 3*a*) are positioned at opposite ends of the line shaft 74. The respective drive sprockets 82, 86 directly drive a first set of endless chains 90, 94, which extend in a vertical direction.

With reference to FIG. 10, the endless chains 90, 94 drive respective two-row sprockets 98, 102. A second set of endless chains 106, 110 is driven by the two-row sprockets 98, 102 and extend in a horizontal direction toward an operator-side of the assembly 10. The endless chains 106, 110 drive respective two-row sprockets 114, 118, which, in turn, drive a third set of vertically-extending endless chains 122, 126. With reference to FIG. 12, the operator-side of the platform 54 is shown fixed to the vertically-extending endless chains 122, 126. Similarly, the back-side of the platform 54 is fixed to the vertically-extending endless chains 90, 94. Such a connection allows the platform 54 to raise and lower with the corresponding movement of the endless chains 90, 94, 122, 126. Also, as shown in FIG. 12, the platform conveyor 58 is supported by the platform 54, such that the platform conveyor 58 will raise and lower with the platform 54 when the motor 70 is activated.

Positioned above the lift assembly 14 is a top frame remover assembly 130 (shown in FIG. 1 only). The top frame remover assembly 130 includes a gripper assembly 134 (shown in the raised position) that is lowered as needed to grab a top frame 138 (see FIG. 3*a*) positioned on top of the stack of separator sheets 42. The gripper assembly 134 is suspended from, and travels along, horizontal rails (not shown). During operation of the separator sheet handling assembly 10, the gripper assembly 134 is positioned above the lift assembly 14 until a top frame 138 is detected on top of the stack of separator sheets 42. Operation of the sheet feed assembly 18 is suspended and the gripper assembly 134 lowers until it engages the top frame 138 and grabs it with pneumatically powered grippers (not shown). The gripper assembly 134 then returns to the raised position and moves along rails until it is over a frame collection bin 146 where the top frame 138 is released by the grippers to fall into the frame collection bin 146. As shown in FIG. 2, the top frame collection bin 146 is positioned beside the lift assembly 14 but it should be understood that the collection bin 146 may be positioned in any available position that is adjacent to the lift assembly 14.

The assembly 10 also includes a top frame detector assembly 150 (FIG. 3*a*) to detect a top frame 138 in the stack of separator sheets 42. Depending on what is loaded onto the lift assembly 14, one or more top frames 138 may be mixed within the stack of separator sheets 42. As such, the top frame detector assembly 150 is operable to differentiate the top frames 138 from the separator sheets 46.

Figure 3A:
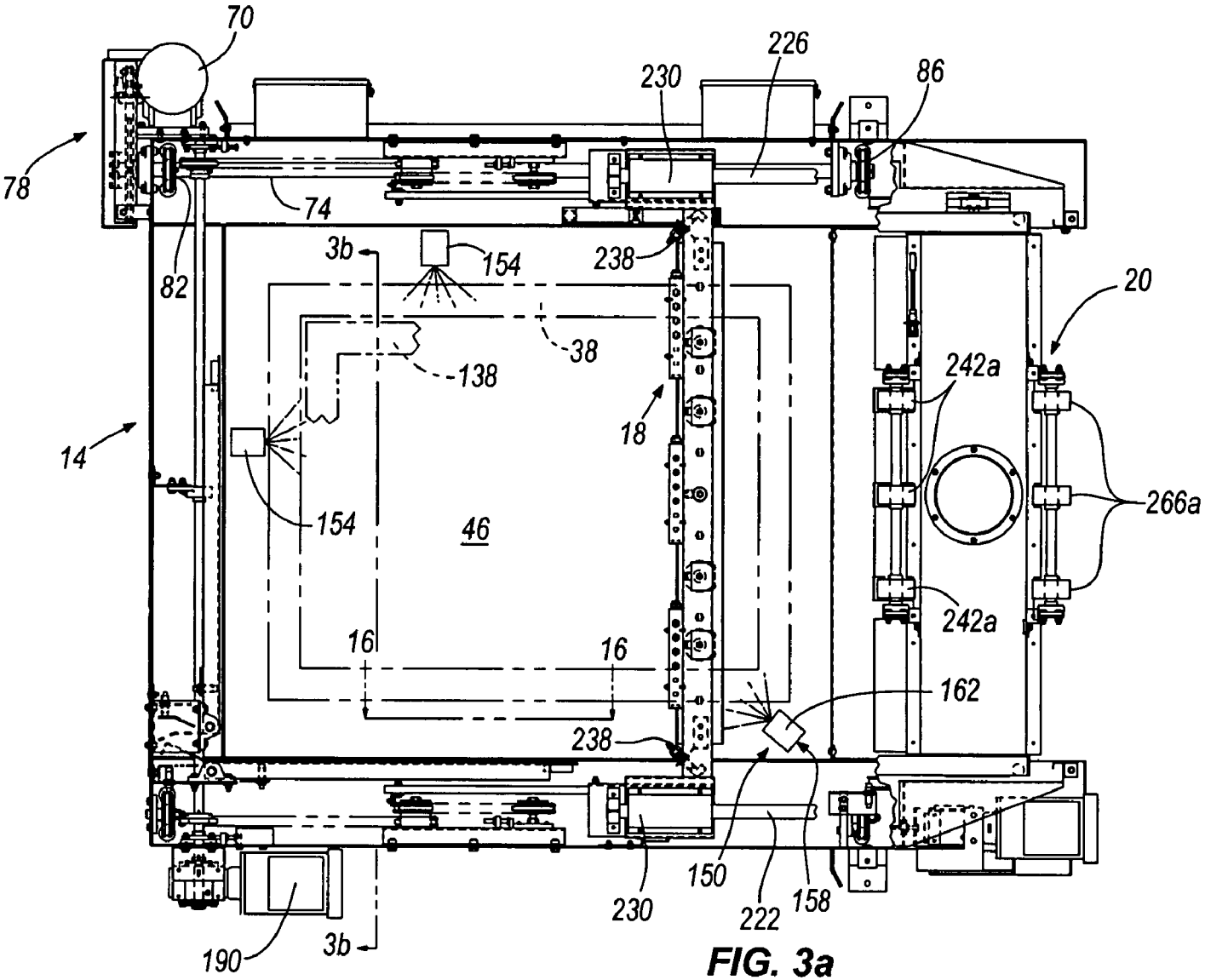
FIG. 3*a* is an enlarged top view of the separator sheet handling system shown in FIG. 1, illustrating a lift assembly with a stack of separator sheets, a feed assembly, and a sheet cleaning assembly.
Figure 3D:
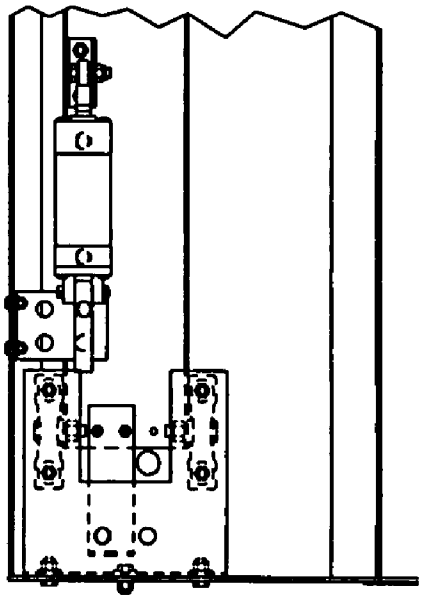
FIG. 3*d* is a cross-sectional view through line 3*d*-3*d* of the lift assembly of FIG. 3*b*.
Figure 3C:
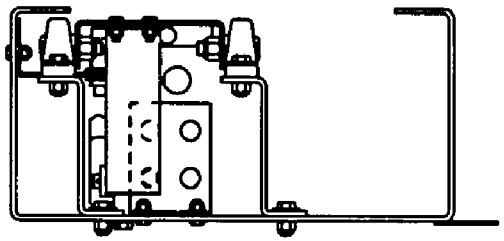
FIG. 3*c* is a cross-sectional view through line 3*c*-3*c* of the lift assembly of FIG. 3*b*.
Figure 3B:
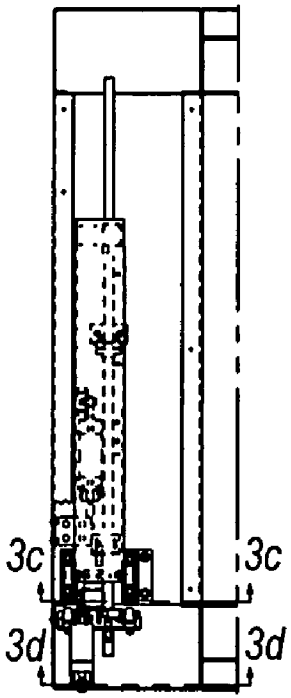
FIG. 3*b* is a cross-sectional view through line 3*b*-3*b* of the lift assembly of FIG. 3*a*.
Figure 4:
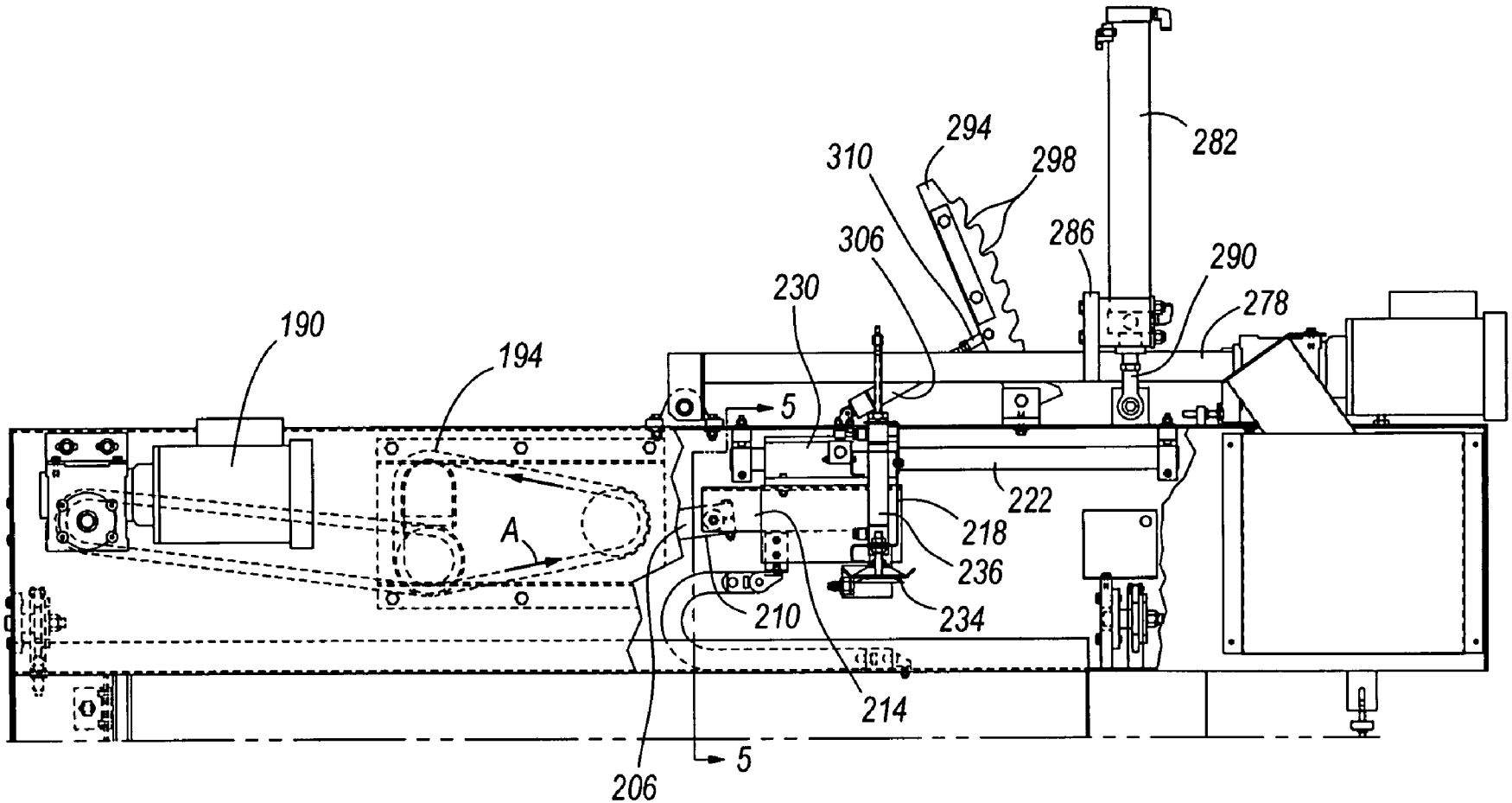
FIG. 4 is an enlarged side view of the feed assembly of FIG. 3*a*.
Figure 5:
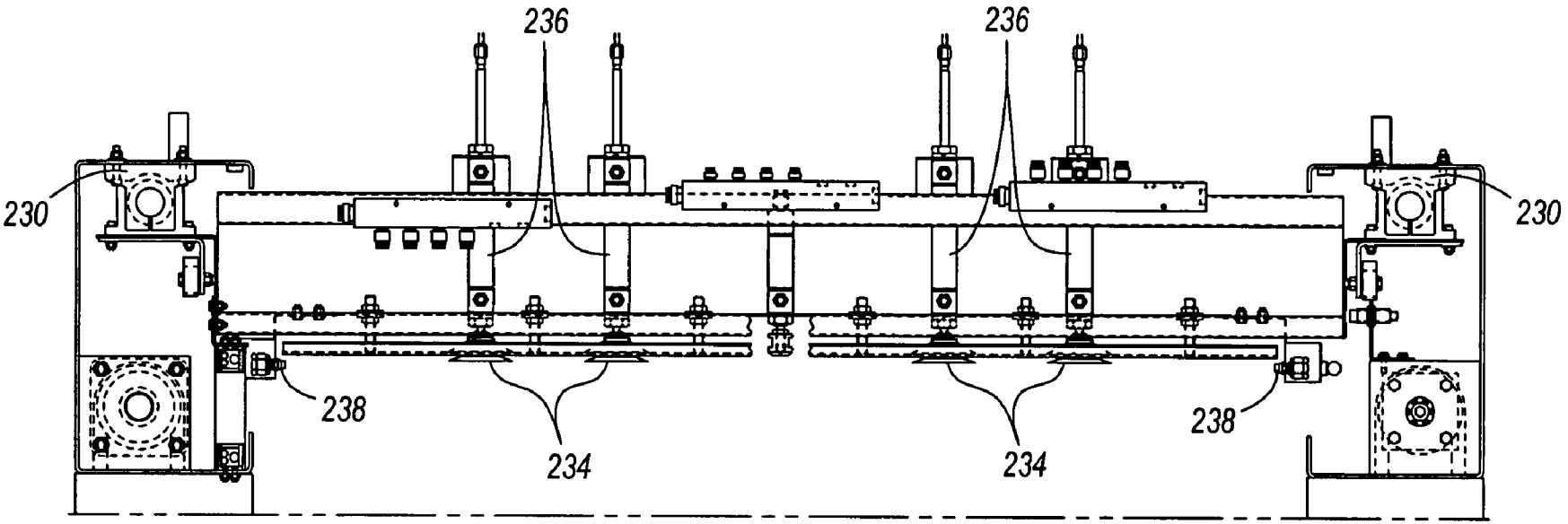
FIG. 5 is a cross-sectional view through line 5-5 of the feed assembly of FIG. 4.

With reference to FIG. 3*a*, the components of the top frame detector assembly 150 are shown positioned above the stack of top frames and separator sheets 42. The top frame detector assembly 150 includes one or more light sources 154 above the stack of top frames and separator sheets 42 that project light onto the stack of top frames and separator sheets 42. In the illustrated construction, the light sources 154 comprise high frequency fluorescent lights. As schematically shown in FIG. 3*a*, the light sources 154 are positioned relative to the stack of top frames and separator sheets 42 so to project light onto the upper left corner of the stack of top frames and separator sheets 42. In another embodiment, a single light source 154 may be used to project light onto the upper left corner of the stack of top frames and separator sheets 42. Further, the light sources 154 may be positioned accordingly to project light onto any of the corners or edges of the stack of top frames and separator sheets 42.

Figure 35:
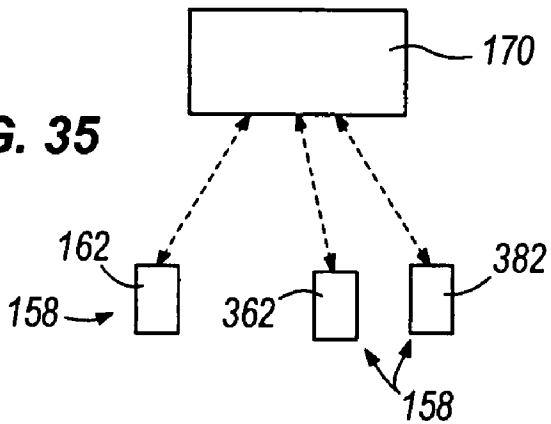
FIG. 35 is a schematic of the electronic components of a frame detector assembly of FIG. 3*a* and the test assembly of FIGS. 24 and 26.
Figure 32:
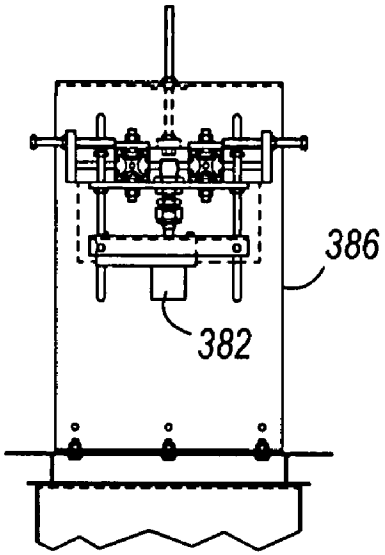
FIG. 32 is a cross-sectional view through line 32-32 of the upper portion of the test assembly of FIG. 28.

In the illustrated embodiment, the top frame detector assembly 150 includes a vision inspection system 158 (see FIG. 35), which includes a digital camera 162, a computer connected to the digital camera, and software loaded on the computer to interface with the camera 162. In the schematic illustrated in FIG. 35, the computer with its software may be integrated with the camera 162 to form a self-contained unit. DVT Sensors, Inc. of Norcross, Ga. provides such a vision inspection system 158 in their line of Legend 500 Series SmartImage Sensors. Like the light sources 154, the camera 162 is preferably positioned above the stack of top frames and separator sheets 42 to focus on the illuminated corner of the stack of top frames and separator sheets 42.

When a separator sheet 46 is at the very top of the stack of top frames and separator sheets 42, the light projected by the light sources 154 illuminates the corner of the separator sheet 46. However, when a top frame 138 is at the very top of the stack of top frames and separator sheets 42, the light projected by the light sources 154 casts a shadow 166 (see FIG. 36) on the separator sheet 46 immediately below the top frame 138 since the top frame 138 has a significant thickness. The camera 162 is operable to view the contrast of the shadow 166 and the light projected by the light sources 154, and determines that a top frame 138 is located at the very top of the stack of top frames and separator sheets 42 at that instant.

In one embodiment, the camera 162 may interface with a programmable logic controller 170 ("PLC," see FIG. 35), which may activate the top frame remover assembly 130 to remove the top frame 138 from the stack of top frames and separator sheets 42. In still another embodiment, an operator may adjust the camera settings and parameters of the vision inspection system 158 with a human-to-machine interface (not shown) or the PLC 170.

In operation of the assembly 10, the camera 162 may be triggered to capture a digital image of the top-most separator sheet 46 or top frame 138 in the stack of top frames and separator sheets 42. Any of a number of different events may be involved in triggering the camera 162. For example, the camera 162 may be triggered once per forward stroke of the feed assembly 18.

Figure 37:
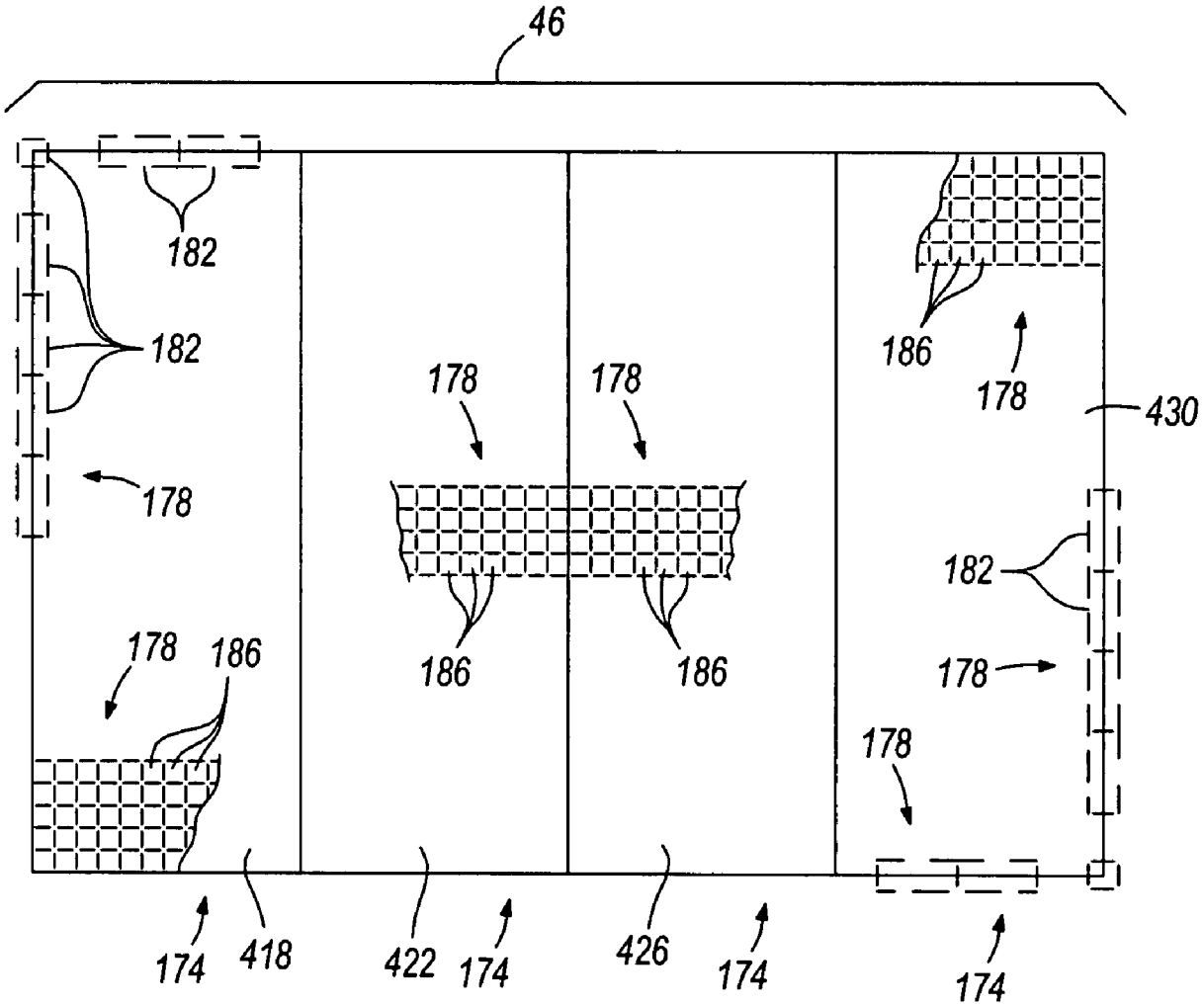
FIG. 37 schematically illustrates the operation of the test assembly.

After the camera 162 captures the image, the image is analyzed by the vision inspection system software. With reference to FIG. 37, the vision inspection system software includes a software program made up of one or more constructs known as "products" 174 to those in the vision inspection industry. Products 174, in turn, are collections of software elements known as "sensors" 178 that process discrete regions of the image looking for specific visual characteristics. In other words, the sensors 178 are not physical devices, or hardware components. Rather, the sensors 178 are software components of the vision inspection system software that analyze a discrete region of a digital image. Such a discrete region may correspond with, for example, a 4"by 4" area on the separator sheet 46. Alternatively, the sensors 178 may correspond with regions on the separator sheet 46 of greater or lesser area.

Figure 36:
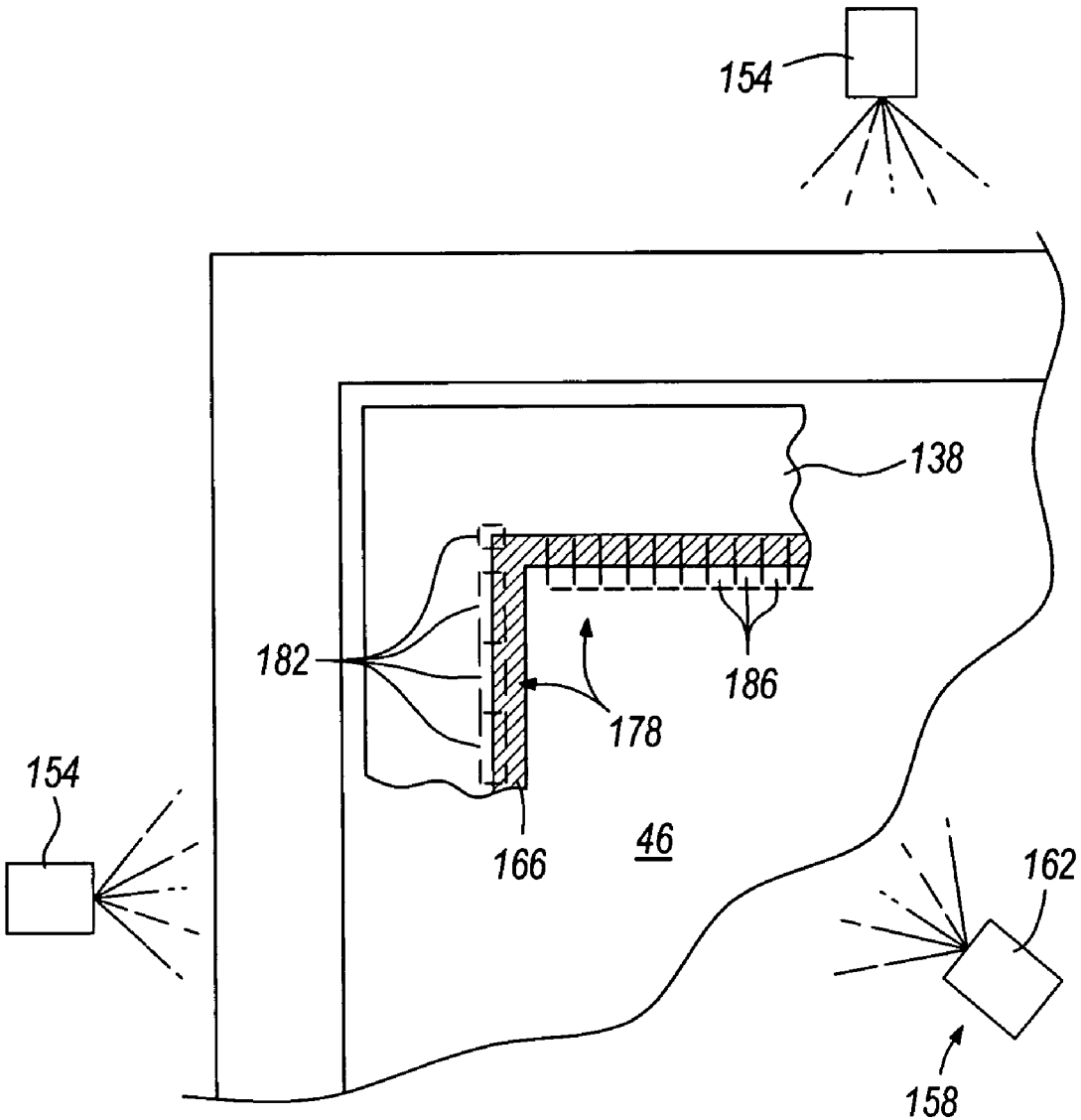
FIG. 36 schematically illustrates the operation of the frame detector assembly.

The sensors 178 analyze the individual pixels which make up the digital image. FIG. 36 is a schematic illustration of an exemplary image captured by the camera 162, at an instant when a top frame 138 is at the very top of the stack of top frames and separator sheets 42. For example, an "edge sensor" 182 may scan the image to determine if an edge, or any substantially straight and substantially continuous line, exists in the image. As shown in FIG. 36, the edge sensor 182 may scan the image and identify the inside edges of the top frame 138. For the vision inspection system software to accomplish this, the edge sensor 182 may look for a group of pixels (e.g., a row of pixels) having a similar brightness level. If such a group or row is found amongst adjacent pixels of substantially different brightness levels, then the vision inspection system software may conclude that an edge or line exists at the interface of the grouped pixels and the surrounding adjacent pixels.

Subsequently, one or more area sensors, or "blob sensors," 186 may scan the image to determine if any characteristics or defects on the sheet, such as footprints, ink blots, tears, markings, debris, or other "blobs" are present in the image. More particularly, when used in the top frame detector assembly 150, the blob sensors 186 may identify the brightness contrast between the shadow 166 cast by the top frame 138 and the underlying separator sheet 46 when the top frame 138 and separator sheet 46 are illuminated by the light sources 154. One or more blob sensors 186 may be aligned with the inside edge(s) of the top frame 138 that was identified by the edge sensor 182 to analyze the individual pixels in the portions of the image outlined by the blob sensors 186. Each blob sensor 186 may look for a group of pixels (e.g., a "blob" of pixels) having a similar brightness level. Such a group of pixels may be identified amongst other surrounding pixels having substantially different brightness levels compared to the group of pixels. If such a group is found, the vision inspection software may conclude that a "blob" exists in the image.

Each blob sensor 186 may also scan its corresponding region of the sheet 46 for areas of differing color or shade from a mean color or shade of the region and compare the size of the areas and the extent of color or shade differentiation to programmed threshold values to determine if the areas qualify as "blobs." In the application of the top frame detector assembly 150, such a blob may be indicative of the shadow 166 cast by the top frame 138. The information may then be relayed from the camera 162 to the PLC 170, so that the PLC 170 may activate the top frame remover assembly 130 to remove the top frame 138.

The vision inspection system software may also identify the pallet 38 after the stack of top frames and separator sheets 42 has been processed. This may be accomplished in a substantially similar process as described above with reference to the top frames 138. After the camera 162 captures a digital image of the pallet 38, the vision inspection system software may apply one or more sensors 178 to identify one or more groups of pixels which substantially contrast with adjacent pixels surrounding the groups. Such groups of pixels may be indicative of particular structural characteristics of the pallet 38 rather than a separator sheet 46. Also, additional sensors (e.g., proximity sensors, etc.) may be used to detect the position of the platform 54 in the lift assembly 14. Combining the output of such additional sensors with the analysis of the pallet image, the vision inspection system software may conclude the object in the image is indeed a pallet 38. Further, the information may then be relayed from the camera 162 to the PLC 170 so that the PLC 170 may activate the platform conveyor 58 to remove the pallet 38 from the platform 54.

The feed assembly 18 is shown in detail in FIGS. 3*a*-5. The feed assembly 18 is adapted for horizontal movement relative to the lift assembly 14 and the alignment assembly 22. Horizontal motion is translated to the feed assembly 18 by a drive 190. With reference to FIGS. 4 and 16-18, the drive 190 maneuvers a chain 194 in an endless pattern as indicated by arrow A in FIG. 4. A bracket 198 is connected to a section of the chain 194 such that the bracket 198 moves along the path of the chain 194. The bracket 198 is pivotally connected to one end 202 of a support arm 206 such that maneuvering the bracket 198 causes movement of the support arm 206. An opposite end 210 of the support arm 206 is pivotally connected to a bracket 214 (see FIG. 4) that is connected to a laterally extending support structure 218 of the feed assembly 18. The pivotal connection between the ends 202, 210 of the support arm 206 and the respective brackets 198, 214 causes the nonlinear motion of the support arm 206 to be translated to horizontal linear motion of the laterally extending support structure 218. As shown in FIG. 3*a*, a pair of support rods 222, 226 extend longitudinally from opposite sides of the laterally extending support structure 218. The support rods 222, 226 are supported for horizontal movement by bearings 230 positioned on opposite sides of the separator sheet handling assembly 10.

The feed assembly 18 includes vacuum fittings 234 that engage the top surface of the separator sheet 46. A preferred form and arrangement of the vacuum fittings 234 are disclosed in PCT/US97/07520, which is incorporated herein by reference. The vacuum fittings 234 may be raised and lowered by cylinders 236 to raise and/or lower the separator sheet 46 from the stack of separator sheets 42.

During operation of the separator sheet handling assembly 10, the feed assembly 18 moves backward and downward to grasp the separator sheet 46 positioned on the top of the stack of separator sheets 42. With reference to FIG. 3*a*, the feed assembly 18 also includes a plurality of nozzles 238 aimed toward the top of the stack of separator sheets 42. The nozzles 238 move air through the lift assembly 14 to facilitate removing only the top separator sheet 46 instead of multiple sheets. More particularly, the nozzles 238 discharge bursts or pulses of compressed air. Without pulsing compressed air through the separator sheets 46, the sheets 46 in the stack of separator sheets 42 often tend to adhere to the top sheet 46 due to moisture, dirt, and/or static, among other reasons.

Figure 21:
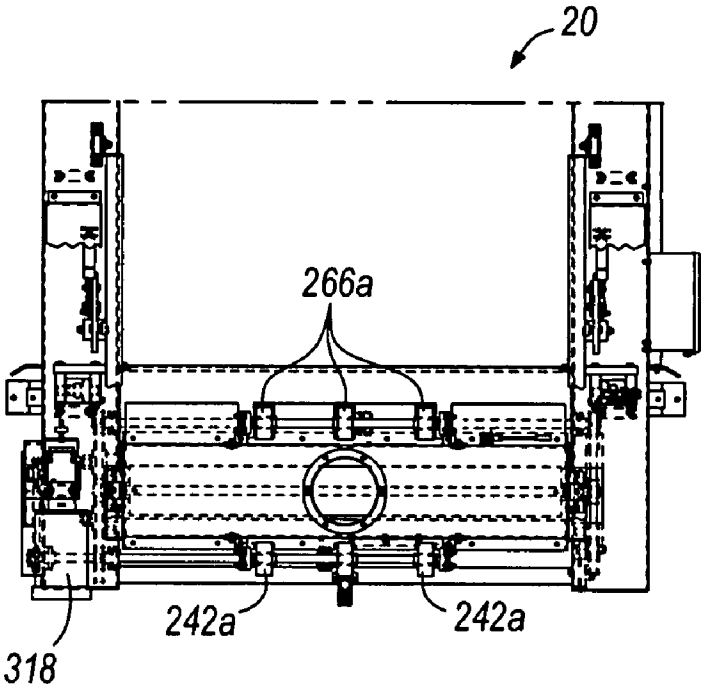
FIG. 21 is a top view of the sheet cleaning assembly of FIG. 19.
Figure 19:
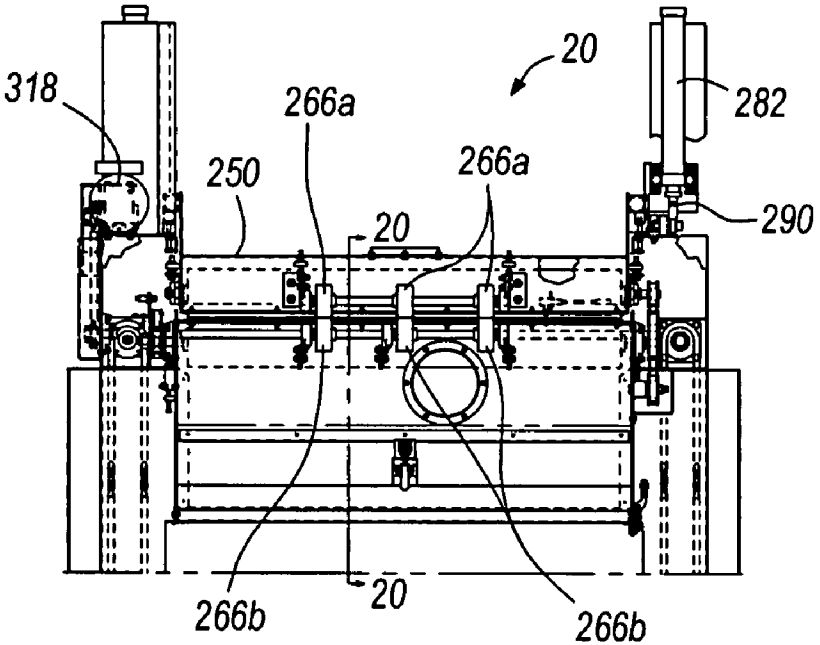
FIG. 19 is an end view of the assemblies, particularly the sheet cleaning assembly, of FIG. 9.
Figure 20:
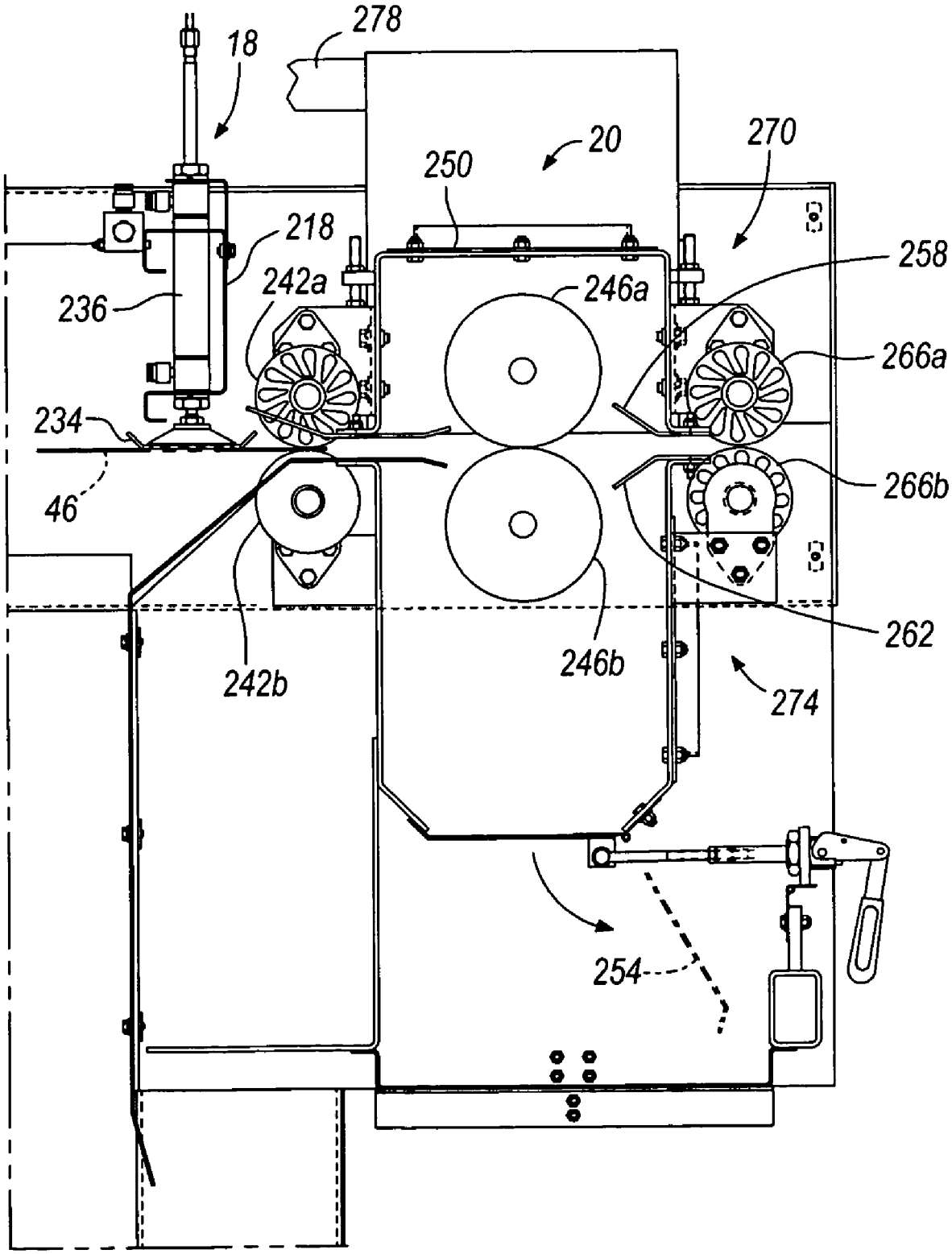
FIG. 20 is a cross-sectional view through line 20-20 of the sheet cleaning assembly of FIG. 19.

Once the vacuum fittings 234 engage the top surface of the separator sheet 46, the feed assembly 18 moves upward and forward to position the separator sheet 46 into the sheet cleaning assembly 20 to remove debris from the separator sheet 46. With reference to FIGS. 19, 20 and 21, the sheet cleaning assembly 20 is shown receiving a separator sheet 46 from the feed assembly 18. The sheet cleaning assembly 20 includes one or more pairs of nipped infeed rollers 242*a*, 242*b*, at least one infeed roller per nipped pair being driven, to receive the leading edge of the separator sheet 46 from the feed assembly 18. From the infeed rollers 242*a*, 242*b*, the separator sheet 46 is transported between opposing brush rollers 246*a*, 246*b* housed within an enclosure 250. The brush rollers 246*a*, 246*b* may comprise a plurality of bristles or other brush elements configured to wipe or brush dust and/or other debris from the separator sheet 46.

In the exemplary construction of the sheet cleaning assembly 20, both of the brush rollers 246*a*, 246*b* may be driven such that both of the upper and lower surfaces of the separator sheet 46 may be brushed. Also, the brush rollers 246*a*, 246*b* may be driven such that the surface speed of the outer periphery of the brush rollers 246*a*, 246*b* is greater than the surface speed of the outer peripheries of the nipped infeed rollers 242*a*, 242*b*. By doing this, progress of the leading edge of the separator sheet 46 through the opposed brush rollers 246*a*, 246*b* may not be impeded.

The enclosure 250 housing the brush rollers 246*a*, 246*b* is substantially sealed to prevent the escape of dust and/or other debris removed from the separator sheet 46. The interior of the enclosure 250 may be under a vacuum, such that the dust or other small debris may be evacuated from the enclosure 250 to a designated disposal container. Also, large debris removed from the separator sheet 46 may be too large or heavy to be evacuated from the enclosure 250. Such large debris may fall to the bottom of the enclosure 250, where the large debris may accumulate before being collected by opening an access panel 254.

After the leading edge of the separator sheet 46 emerges from the opposed brush rollers 246*a*, 246*b*, opposing guides 258, 262 help direct the brushed leading edge of the separator sheet 46 toward one or more pairs of nipped outfeed rollers 266*a*, 266*b*, at least one outfeed roller per nipped pair being driven. The outfeed rollers 266*a*, 266*b* are similar in size to the infeed rollers 242*a*, 242*b* and are driven at substantially the same rotational speed as the infeed rollers 242*a*, 242*b*, such that the surface speed of the outer peripheries of the outfeed rollers 266*a*, 266*b* is substantially the same as the surface speed of the outer peripheries of the infeed rollers 242*a*, 242*b*. As a result, since any one separator sheet 46 dwells between the nips of either the infeed rollers 242*a*, 242*b* or the outfeed rollers 266*a*, 266*b* at any given time as the separator sheet 46 is transported through the sheet cleaning assembly 20, the separator sheet 46 is maintained at substantially the same speed as it is transported through the sheet cleaning assembly 20.

Figure 22:
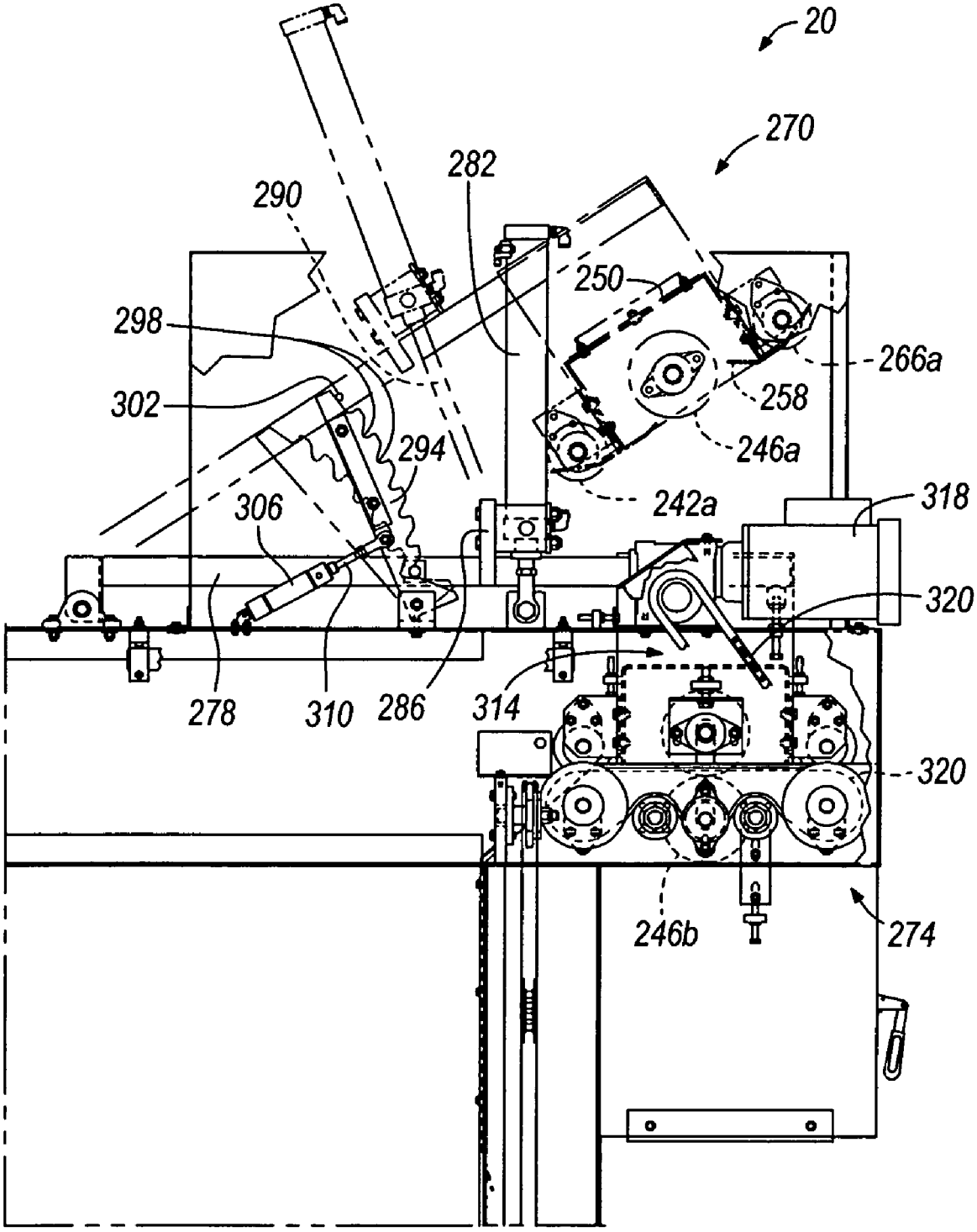
FIG. 22 is an operator-side view of the sheet cleaning assembly of FIG. 19.

With reference to FIG. 22, an upper brush sub-assembly 270 and a lower brush sub-assembly 274 are shown comprising the sheet cleaning assembly 20. The upper brush sub-assembly 270 is movable away from the lower brush sub-assembly 274 to provide access to the space between the respective brush sub-assemblies 270, 274. In the illustrated construction, the upper brush sub-assembly 270 is shown pivotally movable relative to the lower brush sub-assembly 274, however, other constructions of the respective brush sub-assemblies 270, 274 may be movable with respect to one another in other manners.

The upper brush sub-assembly 270 includes the upper infeed rollers 242*a*, the upper brush roller 246*a*, and the upper outfeed rollers 266*a*. The upper brush sub-assembly 270 also includes an upper portion of the enclosure 250 and the upper guide 258. The upper brush sub-assembly 270 is pivotally supported with respect to the lower brush sub-assembly 274 by an arm 278. A cylinder 282 (e.g., a pneumatic cylinder) is actuable to cause the upper brush sub-assembly 270 to pivot relative to the lower brush sub-assembly 274. As shown in FIG. 22, the cylinder 282 is pivotally supported on the arm 278 by a bracket 286 fixed to the arm 278. The cylinder 282 includes an extensible rod 290, which is connected to the base frame of the assembly 10, such that extension of the rod 290 causes the arm 278 to pivot upwardly. The pivotal connection between the cylinder 282 and the bracket 286 allows the cylinder 282 to pivot as the rod 290 extends.

With continued reference to FIG. 22, an auxiliary support 294 for the arm 278 is shown. The auxiliary support 294 includes a plurality of notches 298 on one side thereof to receive a pin 302 fixed to the arm 278. The auxiliary support 294 may be actuated by a cylinder 306 (e.g., a pneumatic cylinder). The cylinder 306 may include an extensible rod 310 that is biased to an extended position (e.g., by springs), such that if the source of compressed air for the cylinder 306 were removed, the auxiliary support 294 would be pivoted to a position in which the pin 302 would engage one of the plurality of notches 298 in the auxiliary support 294 to provide additional support for the arm 278 and the upper brush sub-assembly 270.

Figure 23:
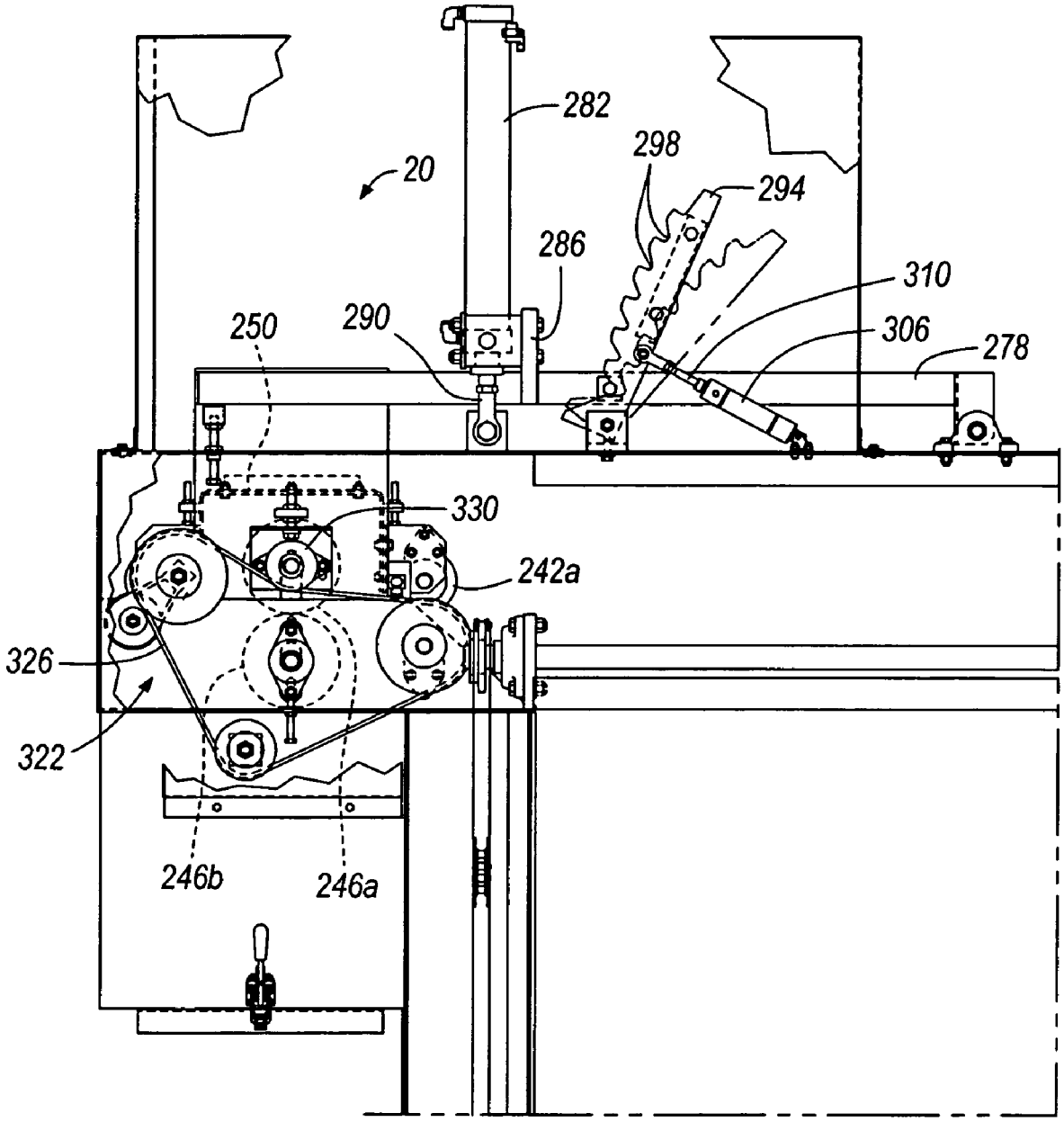
FIG. 23 is a rear view of the sheet cleaning assembly of FIG. 19.

Since the upper and lower brush sub-assemblies 270, 274 are separable from one another, a drivetrain 314 configured to accommodate such movement is required. With continued reference to FIG. 22, the drivetrain 314 of the lower brush sub-assembly 274 is shown on the operator side of the sheet cleaning assembly 20. A motor 318 is operable to power multiple chains 320 to drive the lower infeed rollers 242*b*, the lower brush roller 246*b*, and the lower outfeed rollers 266*b*. The motor 318 is fixed to the base frame of the assembly 10, such that it does not pivot with the upper brush sub-assembly 270. With reference to FIG. 23, a drivetrain 322 of the upper brush sub-assembly 270 is shown on the back side of the sheet cleaning assembly 20. The drivetrain 322 includes an endless belt 326 that is driven by the lower infeed rollers 242*b*, which receive power directly from the motor 318 via the aforementioned chains 320. When the upper brush sub-assembly 270 is lowered onto the lower brush sub-assembly 274, a sprocket 330 fixed to the upper brush roller 246*a* drivingly engages the belt 326. The belt 326 is somewhat flexible, such that it is allowed to deflect and at least partially wrap around the sprocket 330 to provide sufficient friction on the sprocket 330 to drive the upper brush roller 246*a*. As shown in FIGS. 22 and 23, the upper infeed rollers 242*a* and the upper outfeed rollers 266*a* are not driven.

The sheet cleaning assembly 20, after removing debris from the separator sheet 46, discharges the separator sheet 46 to the alignment assembly 22. The separator sheet 46 is carried through the alignment assembly 22 by an endless belt 334 (see FIG. 24) which is positioned across the width of the separator sheet handling assembly 10. As the separator sheet 46 travels through the alignment assembly 22, the separator sheet 46 is maneuvered by guides 338 (see FIG. 2) into a predetermined position. The separator sheet 46 needs to be maneuvered into this predetermined position so that the separator sheet 46 is properly positioned as it enters the test assembly 26. The endless belt 334 also transports the separator sheet 46 to the test assembly 26.

With reference to FIG. 1, the test assembly 26 is shown as including a lower test sub-assembly 342 and an upper test sub-assembly 346. The lower test sub-assembly 342 is operable to monitor or analyze the lower or bottom surface of the separator sheet 46 as it passes through the test assembly 26, while the upper test sub-assembly 346 is operable to monitor or analyze the upper or top surface of the separator sheet 46 as it passes through the test assembly 26. Since both the top and bottom surfaces of the separator sheet 46 are analyzed, unobstructed views of the top and bottom surfaces of the separator sheet 46 are required when the sheet 46 passes through the test assembly 26. As such, the endless belt 334 is not allowed to continue through the test assembly 26. Rather, the endless belt 334 stops before entering the test assembly 26, and a plurality of thin linear elements (e.g., piano wires 350) span the length of the test assembly 26 to support the separator sheet 46 as it passes through the test assembly 26. The piano wires 350 terminate at the outlet of the test assembly 26, where a second endless belt 354 picks up the separator sheet 46 for transport to either of the first or second storage assemblies 30, 34.

Figure 24:
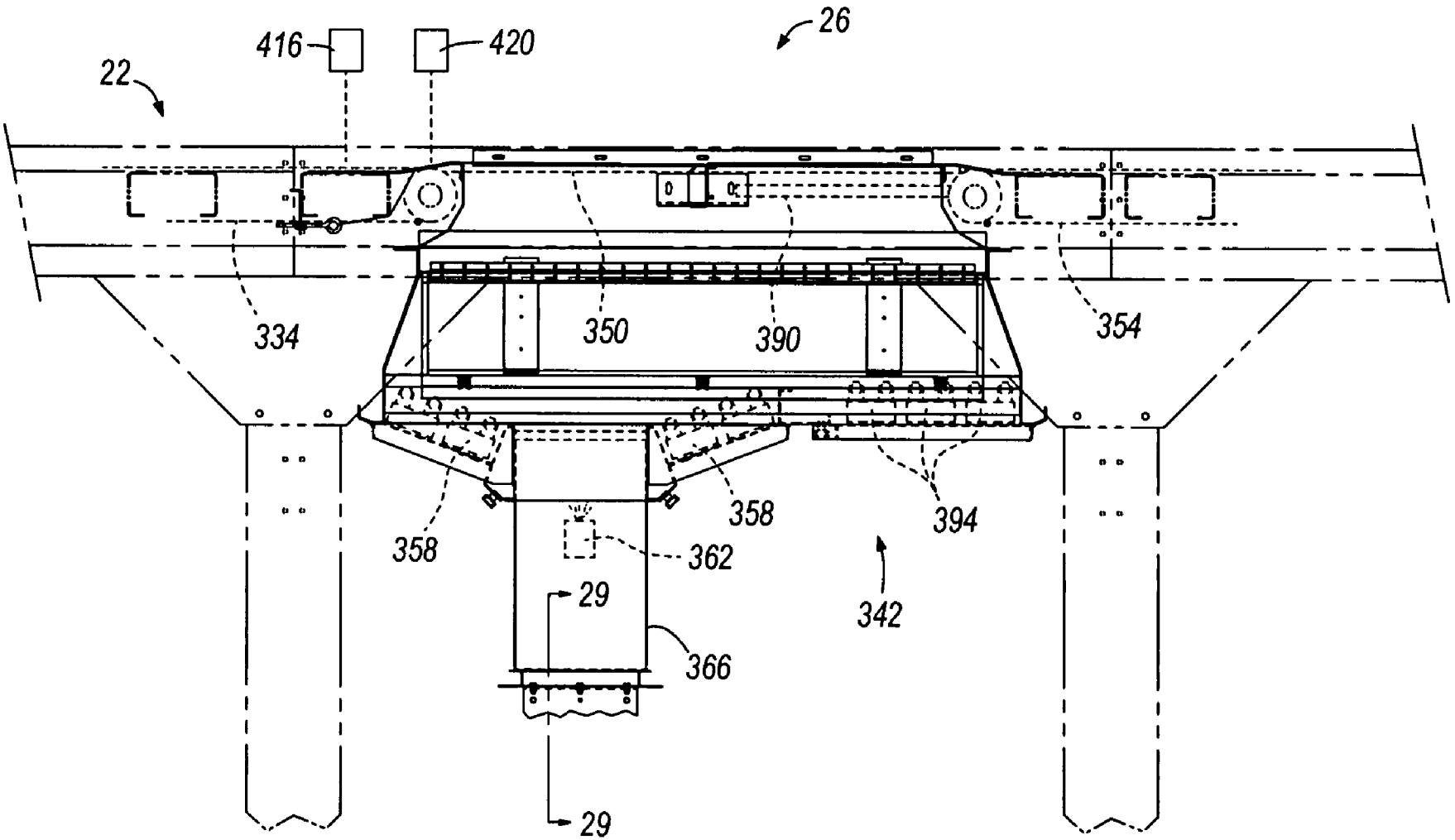
FIG. 24 is an enlarged side view of a lower portion of a test assembly of the separator sheet handling assembly of FIG. 1.
Figure 25:
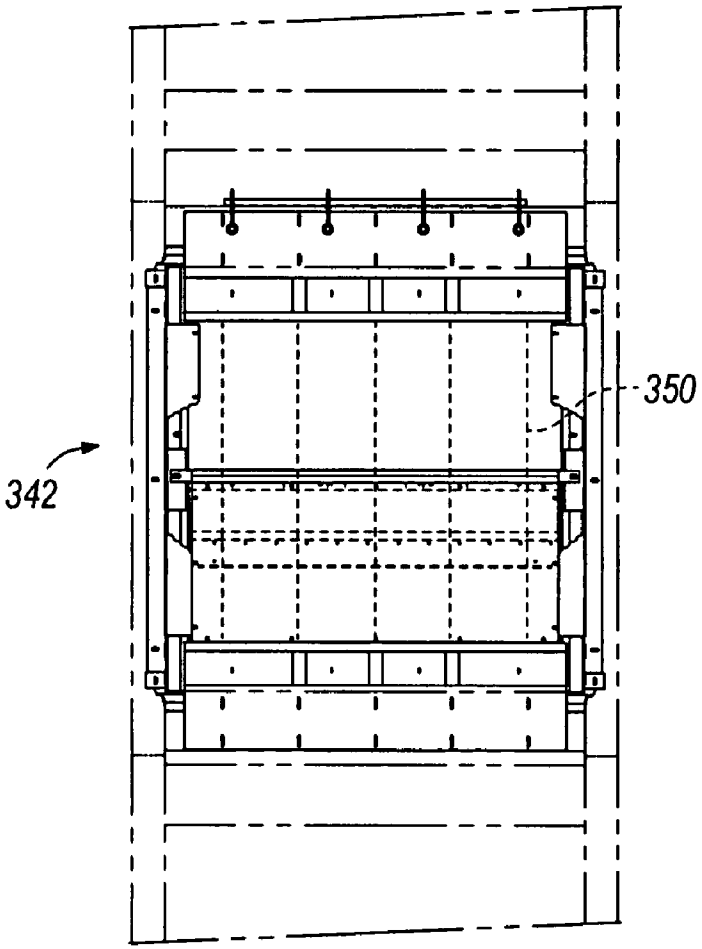
FIG. 25 is a top view of the lower portion of the test assembly of FIG. 24.
Figure 26:
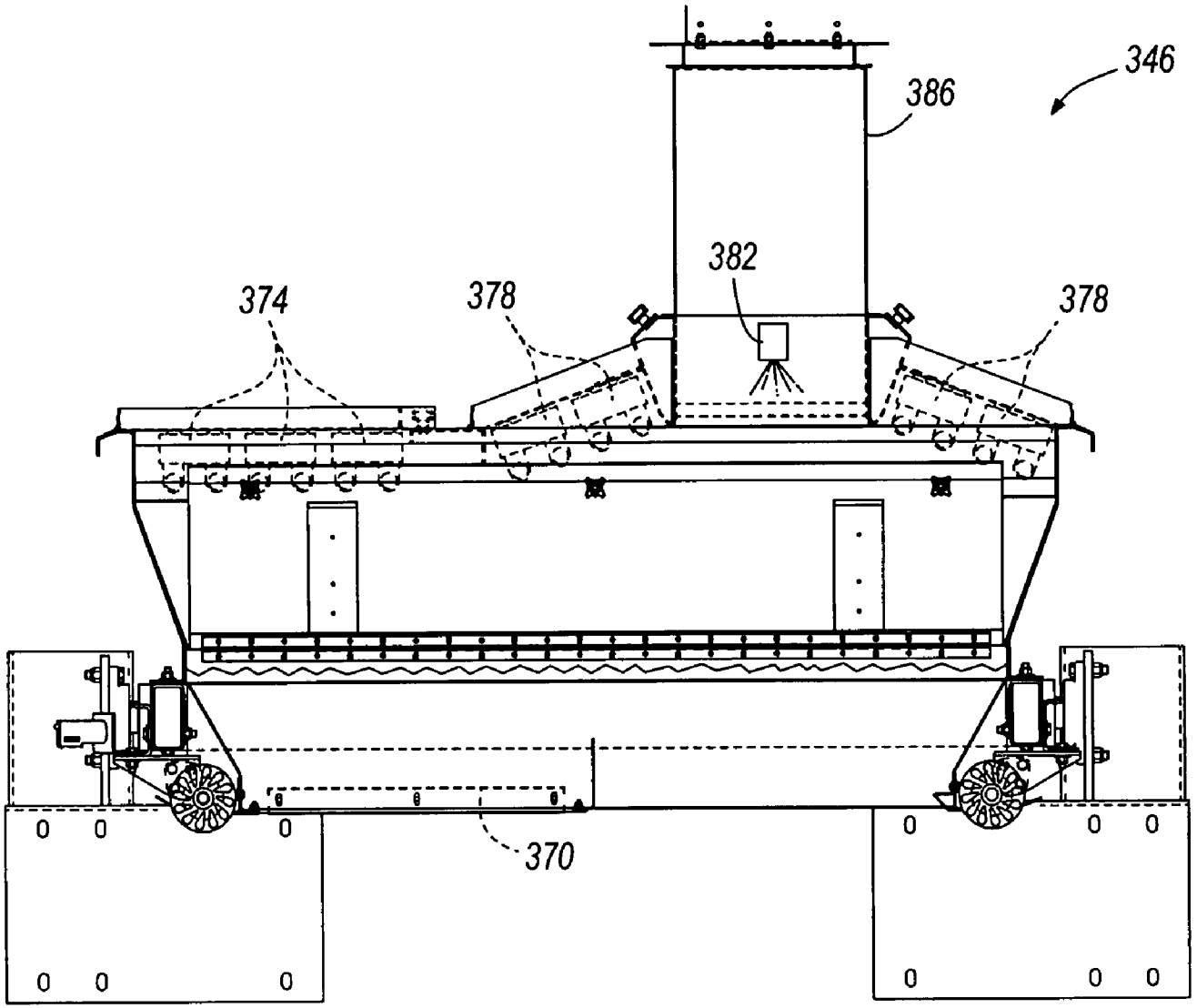
FIG. 26 is an enlarged side view of an upper portion of the test assembly of the separator sheet handling assembly of FIG. 1.

The lower test sub-assembly 342 is shown in FIGS. 24 and 25. With reference to FIG. 24, the lower test sub-assembly 342 includes a plurality of light sources 358 to illuminate the bottom surface of the separator sheet 46. In the illustrated construction, the light sources 358 comprise high frequency fluorescent lights. A first digital camera 362, like the digital camera 162 utilized in the top frame detector assembly 150, is housed in an enclosure 366 surrounded by the plurality of light sources 358. A first translucent background sheet 370 (e.g., Plexiglas™) may be positioned opposite the camera 362, such that the separator sheet 46 is disposed between the piano wire 350 and the background sheet 370 as the separator sheet 46 passes above the camera 362. With reference to FIG. 26, a plurality of background light sources 374 are positioned above the first translucent background sheet 370 to provide background lighting to the separator sheet 46 as it passes over the first digital camera 362. The combination of the light sources 358 and the background light sources 374 substantially prevents the formation of shadows over the top and bottom surfaces of the separator sheet 46. In addition, the background light sources 374 may assist in outlining the edges of the separator sheet 46. The background sheet 370 may also include a white coating on the surface of the sheet 370 facing the separator sheet 46 to provide a white background for the digital image captured by the camera 362. Such a white coating on the background sheet 370 provides a stark contrast to the separator sheet 46 during analysis of the image of the lower surface of the separator sheet 46 in identifying the edges of the sheet 46.

Figure 27:
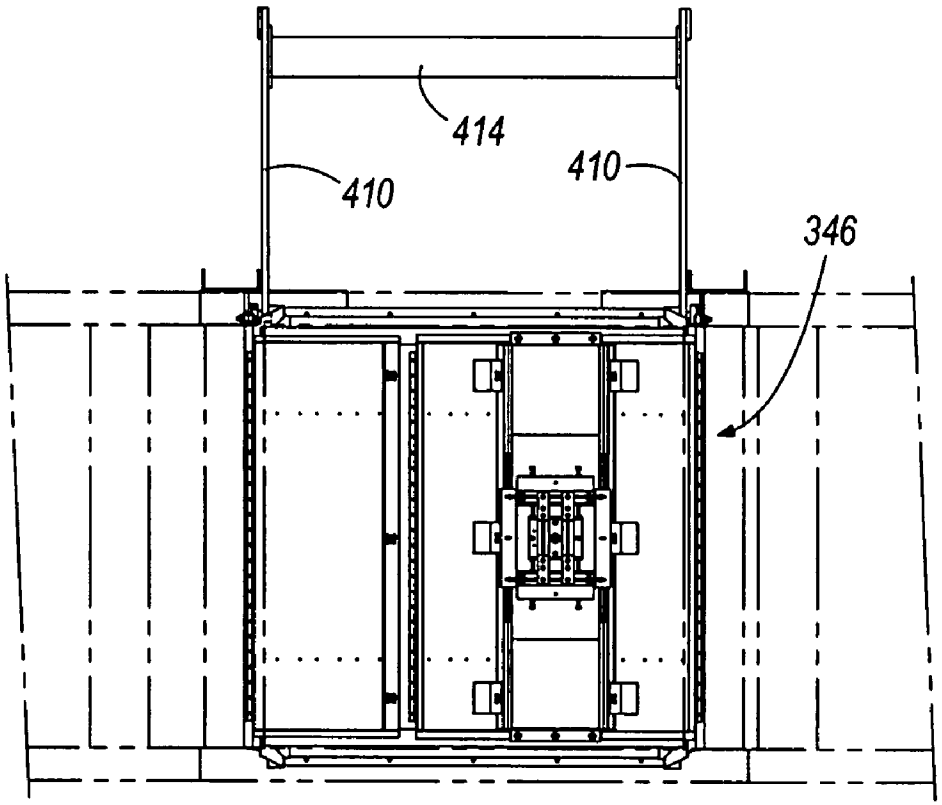
FIG. 27 is a top view of the upper portion of the test assembly of FIG. 26.
Figure 28:
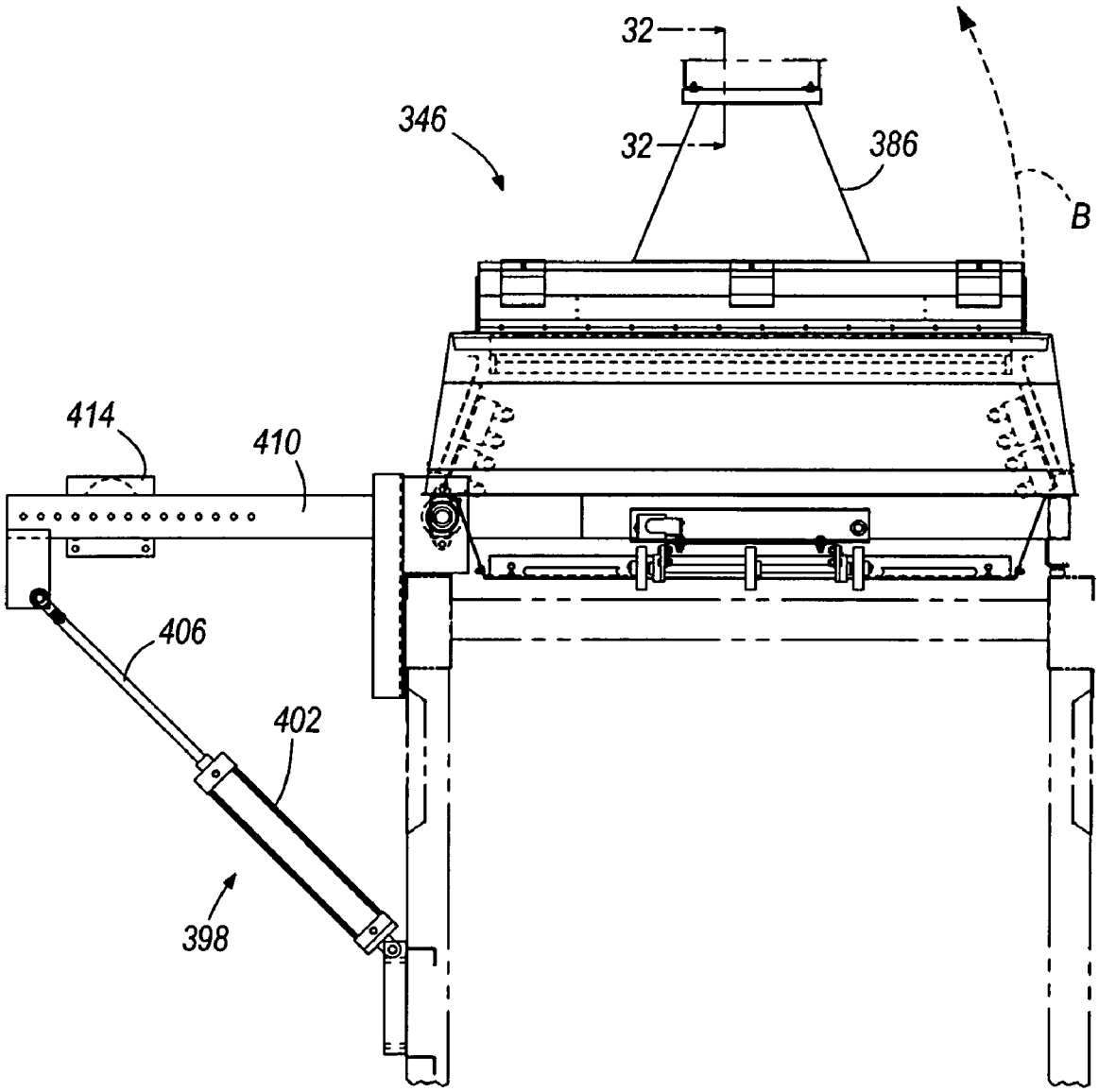
FIG. 28 is an end view of the upper portion of the test assembly of FIG. 26.
Figure 31:
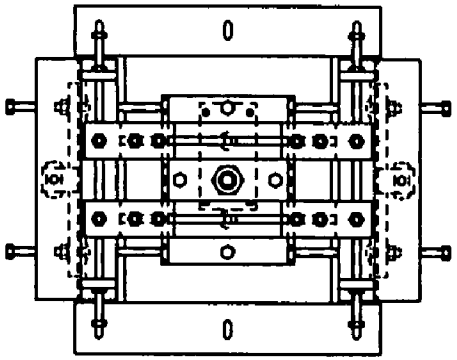
FIG. 31 is a bottom view of the lower portion of the test assembly of FIG. 30.
Figure 30:
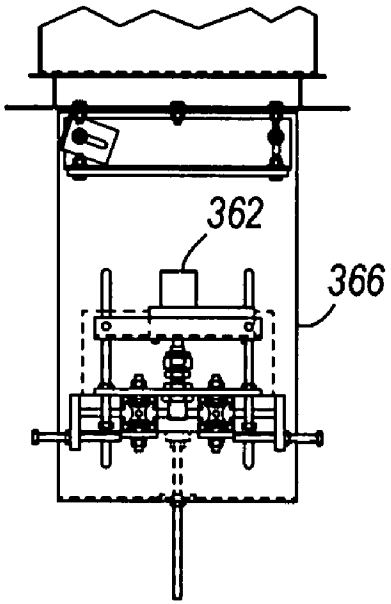
FIG. 30 is a cross-sectional view through line 30-30 of the lower portion of the test assembly of FIG. 29.
Figure 29:
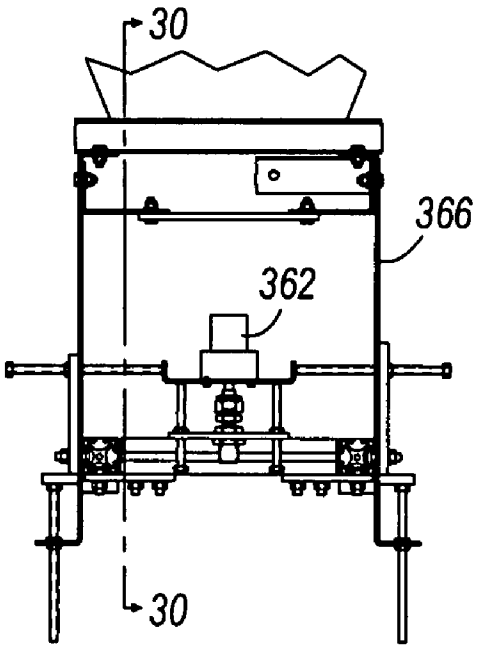
FIG. 29 is a cross-sectional view through line 29-29 of the lower portion of the test assembly of FIG. 24.
Figure 34:
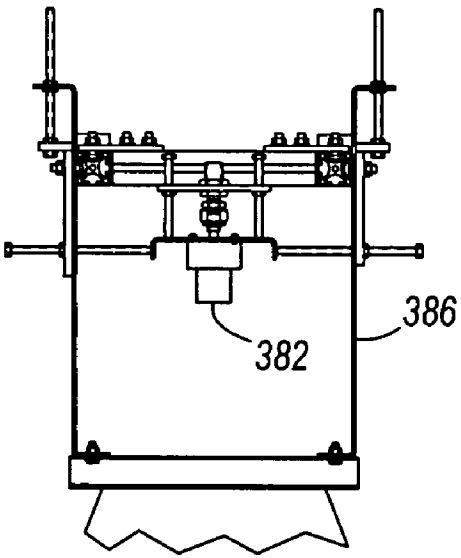
FIG. 34 is a cross-sectional view through line 34-34 of the upper portion of the test assembly of FIG. 33.
Figure 33:
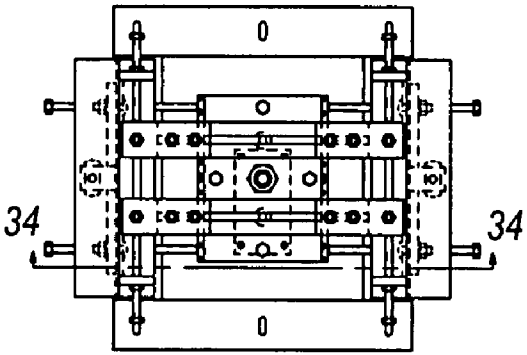
FIG. 33 is a top view of the upper portion of the test assembly of FIG. 32.

The upper test sub-assembly 346 is shown in FIGS. 26-28. With reference to FIG. 26, the upper test sub-assembly 346 includes a plurality of light sources 378 to illuminate the top surface of the separator sheet 46. In the illustrated construction, the light sources 378 comprise high frequency fluorescent lights. A second digital camera 382 like the first digital camera 362 is housed in an enclosure 386 surrounded by the plurality of light sources 378. A second translucent background sheet 390 similar to the first background sheet 370 may be positioned opposite the camera 382, such that the separator sheet 46 is supported by the piano wire 350, and the background sheet 390 is positioned below the piano wire 350.

With reference to FIG. 24, a plurality of background light sources 394 are positioned below the second translucent background sheet 390 to provide background lighting to the separator sheet 46 as it passes below the second digital camera 382. The combination of the light sources 378 and the background light sources 394 substantially prevents the formation of shadows over the top and bottom surfaces of the separator sheet 46. In addition, the background light sources 394 may assist in outlining the edges of the separator sheet 46. The background sheet 390 may also include a white coating on the surface of the background sheet 390 facing the separator sheet 46 to provide a white background for the digital image captured by the camera 382. Such a white coating on the background sheet 390 provides a stark contrast to the separator sheet 46 during analysis of the image of the top surface of the separator sheet 46 in identifying the edges of the sheet 46.

With reference to FIG. 28, the upper test sub-assembly 346 is pivotally coupled to the lower test sub-assembly 342 for pivotal movement in the direction of arrow B. This allows an operator to access either of the cameras 362, 382 or any of the light sources 358, 378 and/or background light sources 374, 394 for repair and/or replacement. The upper test sub-assembly 346 may be pivoted by a cylinder 398 actuated by a source of compressed air or pressurized fluid. The cylinder 398 includes a housing 402 and an extensible rod 406. In the illustrated construction, the housing 402 is pivotally coupled to the frame of the test assembly 26, while the rod 406 is pivotally coupled to a lever arm 410 extending from the upper test sub-assembly 346. A counterweight 414 is coupled to the lever arm 410 to assist the cylinder 398 in pivoting the upper test sub-assembly 346. When opening the test assembly 26 (i.e., pivoting the upper test sub-assembly 346 away from the lower test sub-assembly 342), the counterweight 414 allows the upper test sub-assembly 346 to be pivoted by the cylinder 398 with minimal effort, compared to the force capacity of the cylinder 398. Also, when closing the test assembly 26 (i.e., pivoting the upper test sub-assembly 346 toward the lower test sub-assembly 342), the counterweight 414 allows the upper test sub-assembly 346 to be pivoted downward at a controlled rate by the cylinder 398. The combination of the cylinder 398, lever arm 410, and counterweight 414 allows the upper test sub-assembly 346 to be pivoted while decreasing the probability of accidental shock or damage to the digital cameras 362, 382.

During operation of the assembly 10, it is difficult to expose the entire top and bottom surfaces of the sheet 46 to the respective cameras 362, 382 at one time. Thus, the cameras 362, 382 are triggered at fixed sheet travel distance intervals to capture discrete images of a fraction of the top and bottom surfaces of the separator sheet 46, with as many images being taken at short enough intervals such that the entire surface of the sheet is imaged. With reference to FIG. 24, a sensor 416 (e.g., a proximity sensor, a light sensor, etc.) may be positioned near the inlet of the test assembly 26 to detect the leading edge of the separator sheet 46, while another sensor 420 may be utilized to output pulses at fixed intervals of movement of the second endless belt 354. Alternatively, other sensor arrangements may be utilized to cause the cameras 362, 382 to trigger at fixed intervals of sheet motion. The sensors 416, 420 may be electrically connected to the PLC 170, which, in turn, may trigger the cameras 362, 382.

The camera 362 may be triggered accordingly such that it captures multiple discrete images of the bottom surface of the separator sheet 46. For example, as the separator sheet 46 enters the test assembly 26, the first or lower camera 362 may be triggered at fixed distance intervals to capture four discrete images of different portions of the bottom surface of the separator sheet 46. After each image is captured by the camera 362, the image may be analyzed by the vision inspection system software.

Likewise, the camera 382 may be triggered accordingly such that it captures multiple discrete images of the top surface of the separator sheet 46. For example, as the separator sheet 46 enters the test assembly 26, the second or upper 382 may be triggered at fixed distance intervals to capture four discrete images of different portions of the top surface of the separator sheet 46. After each image is captured by the camera 382, the image may be analyzed by the vision inspection system software. Alternatively, the cameras 362, 382 may be configured to capture a different number of images of the respective bottom and top surfaces of the separator sheet 46. In addition, an operator may adjust the settings and parameters of the cameras with a human-to-machine interface (not shown) or the PLC 170.

Each image may be tested with a different product 174 that has sensors 178 configured appropriately for the nature of the image captured. With reference to FIG. 37, there are three different types of images captured by each camera 362, 382 as the separator sheet 46 passes through the test assembly 26. The first image 418 includes the leading edge portion of the separator sheet 46. The second image 422 and the third image 426 look substantially identical, and each show a band of the middle portion of the sheet 46, with the leading and trailing edges out of view. The last and fourth image 430 shows the trailing edge portion of the sheet 46. The sensor layouts within each product 174 are tailored for the type of image seen (e.g., leading edge portion, middle portion, and trailing edge portion). Separate products 174 may be utilized to test the second and third images 422, 426 captured even though the sensor layouts on the images 422, 426 are substantially identical. This may be done so that the quantitative sensitivity and result data for the second and third images 422, 426 can be differentiated.

In the illustrated embodiment, the products 174 include one or more edge sensors 182 to scan the images 418, 422, 426, 430 to determine if any edge characteristics or edge defects exist on a top or bottom surface of the sheet 46. Such edge characteristics or edge defects may include, for example, wrinkled or torn edges or corners. For an edge sensor 182 to identify such edge defects, each edge sensor 182 may look for a group of pixels (e.g., a row of pixels) having a similar brightness level. If such a group or row is found amongst adjacent pixels of substantially different brightness levels, then the vision inspection system software may conclude that an edge or line exists at the interface of the grouped pixels and the surrounding adjacent pixels. After identifying one or more edges of the sheet 46, the edge sensor 182 may interface with a "script sensor", which is described in more detail below, to determine the quality of the edge.

In the illustrated embodiment, the products 174 also include one or more blob sensors 186 to scan the images 418, 422, 426, 430 to determine if any characteristics or defects exist on a top or bottom surface of the sheet 46. Such characteristics or defects may include, for example, footprints, ink blots, tears, holes, markings, debris, or other surface contaminants present in the images 418, 422, 426, 430. Each blob sensor 186 may look for a group of pixels (e.g., a "blob" of pixels) having a similar brightness level. Such a group of pixels may be identified amongst other surrounding pixels having substantially different brightness levels compared to the group of pixels. If such a group is found, the vision inspection software may conclude that a "blob" exists in the image 418, 422, 426, or 430. Each blob sensor 186 may also scan its corresponding region of the sheet 46 for areas of differing color or shade from a mean color or shade of the region and compare the size of the areas and the extent of color or shade differentiation to programmed threshold values to determine if the areas qualify as "blobs," or defects in the sheet 46. Such a "blob" may be indicative of footprints, ink blots, tears, holes, markings, debris, or other surface contaminants present on the corresponding separator sheet 46.

Each sensor 178 (e.g., an edge sensor 182 or a blob sensor 186) outputs a pass/fail result, and may also output one or more quantitative results appropriate to the type of test it performs. The pass/fail result for a given sensor 178 is typically the comparison of one or more of these quantitative results to threshold values configured into the individual sensor 178 by the PLC 170. For example, a blob sensor 186 may include threshold values relating to intensity, contrast, blob size (i.e., how many pixels define the "blob"), and/or blob count (i.e., the number of "blobs" determined by the blob sensor 186). If a threshold value is exceeded, the blob sensor 186 would output a "fail" result to the PLC 170, indicating that the corresponding portion of the sheet 46 analyzed by the blob sensor 186 contains a defect characteristic, such as an ink spot, associated with it. Further, if any sensor 178 in any product 174 of either side of the sheet 46 outputs a "fail" result, the entire sheet 46 would fail visual inspection and would be routed to the second storage assembly 34.

In a further embodiment, each blob sensor 186 performs multiple scans of its corresponding region of the sheet 46 with differing threshold values of size of area and extend of differing color or shade from a mean color or shade of the region to determine if the areas are defects in the separator sheet. In still another embodiment, the sensors for each region of the sheet 46 measures mean color or shade of each region, minimum color or shade of each region, and maximum color or shade of each region, whereby the vision inspection system compares these values with the at least one threshold value for the region to determine if there defects in the separator sheet.

As previously mentioned, there also exists another type of sensor 178 known as a "script sensor" that operates similarly in concept to a Visual Basic script in Microsoft Office™ and other software products. The script sensor is capable of reading and/or writing individual sensor result values and/or threshold/sensitivity settings. The script sensor may also dictate the pass/fail result for the product 174 that is the result of a more complex calculation of individual sensor results than a simple logical and summation of all visual sensors 178. For example, quality values for the edges of the sheet 46 and/or quality values for the corners of the sheet 46 may be determined using script sensors in combination with edge sensors 182. Edge quality of the sheet 46 may be determined using a "sum" threshold value and/or a "peak" threshold value. A sheet 46 may fail as the result of the sum threshold value being exceeded, or the sheet 46 having many small edge defects, such as small tears, holes, or wrinkles. A sheet 46 may also fail as the result of the peak threshold value being exceeded, or the sheet 46 having one large edge defect, such as a large tear or wrinkle.

The pass/fail result of each sensor 178 in each product 174 on both sides (top and bottom) of the sheet 46 is compiled by the vision inspection system software, and a single "pass/fail" result for the sheet 46 is output to the PLC 170. For a sheet 46 to fail, only one of the sensors 178 needs to output a "fail" result. The PLC 170 may then use the pass/fail information to determine where to route the sheet 46.

An operator may provide input to the PLC 170 to control or adjust the sensitivity of the cameras 362, 382 to detect characteristics. More particularly, the PLC 170 may write one or more tables of numeric data into the cameras 362, 382, such that the tables of data are transferred into individual sensors 178 by the script sensors to control individual sensor sensitivity. This may be desirable to focus the analysis of the separator sheet 46 to one particular portion of the sheet 46. For example, the sensitivity of one particular sensor 178 corresponding with a region of the sheet to have known markings may be decreased by the operator's input, while the sensitivity of an adjacent sensor 178 corresponding with a region of the sheet that has no known markings may be increased by the operator's input. That is, the sensitivity of the sensors 178 in each region is controlled separately from the sensitivity in other regions. In addition, the sensitivity of any of the sensors 178 may be decreased a substantial amount by the operator via the PLC 170 to effectively deactivate the sensors 178 to allow sheets 46 with known markings (e.g., bar codes, printed characters, etc.) in known regions on the sheet 46 to pass visual inspection.

Another script sensor may gather the results (i.e., a pass or fail result) of the individual sensors 178 and transfer those results into another table that may be referenced by the PLC 170 to tabulate sheet data, which may be referenced by an operator. Each product 174 may read and/or write to different areas of the tables so that a numeric "composite" of the entire sheet 46 may be generated using the four discrete images 418, 422, 426, 430.

The PLC 170 may analyze the images 418, 422, 426, 430 for patterns that are part of a larger pattern purposefully printed on the surface of the sheet 46. If the printed pattern is recognized by the PLC 170, the sheet 46 may pass visual inspection. The PLC 170 may also recognize differing orientations of the same asymmetric printed pattern on the sheet 46. Such a scenario may occur when identical sheets 46 are not consistently oriented with respect to each other before entering the test assembly 26, such as the sheet 46 is rotated 180° or is turned over.

The PLC 170 may be adaptive to variations in the position of such printed patterns to reject a particular sheet 46 on the basis of defects found outside of the detected location of the printed pattern but within the area where the printed pattern can be found on other sheets 46 that are not consistently oriented with respect to the particular sheet 46.

The PLC 170 may also apply multiple pattern analyses to the images 418, 422, 426, 430 such that multiple printed patterns on the sheets 46 can be recognized to allow the sheets 46 to pass visual inspection. To accomplish this, a simple pattern recognition algorithm may be applied to a pseudo-image that has the resolution of the number of discrete regions into which the sheet 46 will be divided (i.e., each discrete region equals one pixel of resolution). The majority of the printed patterns on the sheets 46 will be configured as color bands or stripes that extend the entire length or width of the sheet 46. There is little that can happen to the sheet 46 that will create a defect that would emulate this "banding" without creating other detectable defects outside the pattern.

If, for example, the pseudo-image of the sheet 46 is divided into 20 discrete regions along the width of the sheet 46 and 30 discrete regions along the length of the sheet 46 for a total of 600 total discrete regions. Such an example is analogous to a spreadsheet of 20×30 cells. A perfect sheet 46 has all empty cells, and a value (e.g., a "fail" result) in any cell indicates a bad sheet 46, unless all of the cells in a particular row or column also have values. The pattern recognition algorithm may define ranges of row or column values that it will accept to allow a sheet 46 to pass visual inspection. In addition, the operator may purposefully select particular cells that would be ignored during analysis.

The test assembly 26 may also perform other tests on the separator sheet 46 that are commonly known in the art, including, but not limited to, checking for load tags and surface contamination (e.g., oil or syrup spots, and footprints). Further, the test assembly 26 may be configured to measure sheet characteristics other than defect characteristics, such as thickness, base color, material (e.g., plastic, craft paper, etc.), and/or moisture content. The test assembly 26 may be configured to measure and recognize color bands, or stripes, printed across the length or width of a surface of the separator sheet 46. Such color bands or stripes may be indicative of the thickness of the separator sheet 46 or some other information or characteristic relating to the sheet 46. Based on the results of the analysis performed by the test assembly 26, the sheets 46 may be sorted into an appropriate destination bin or storage assembly.

Figure 6:
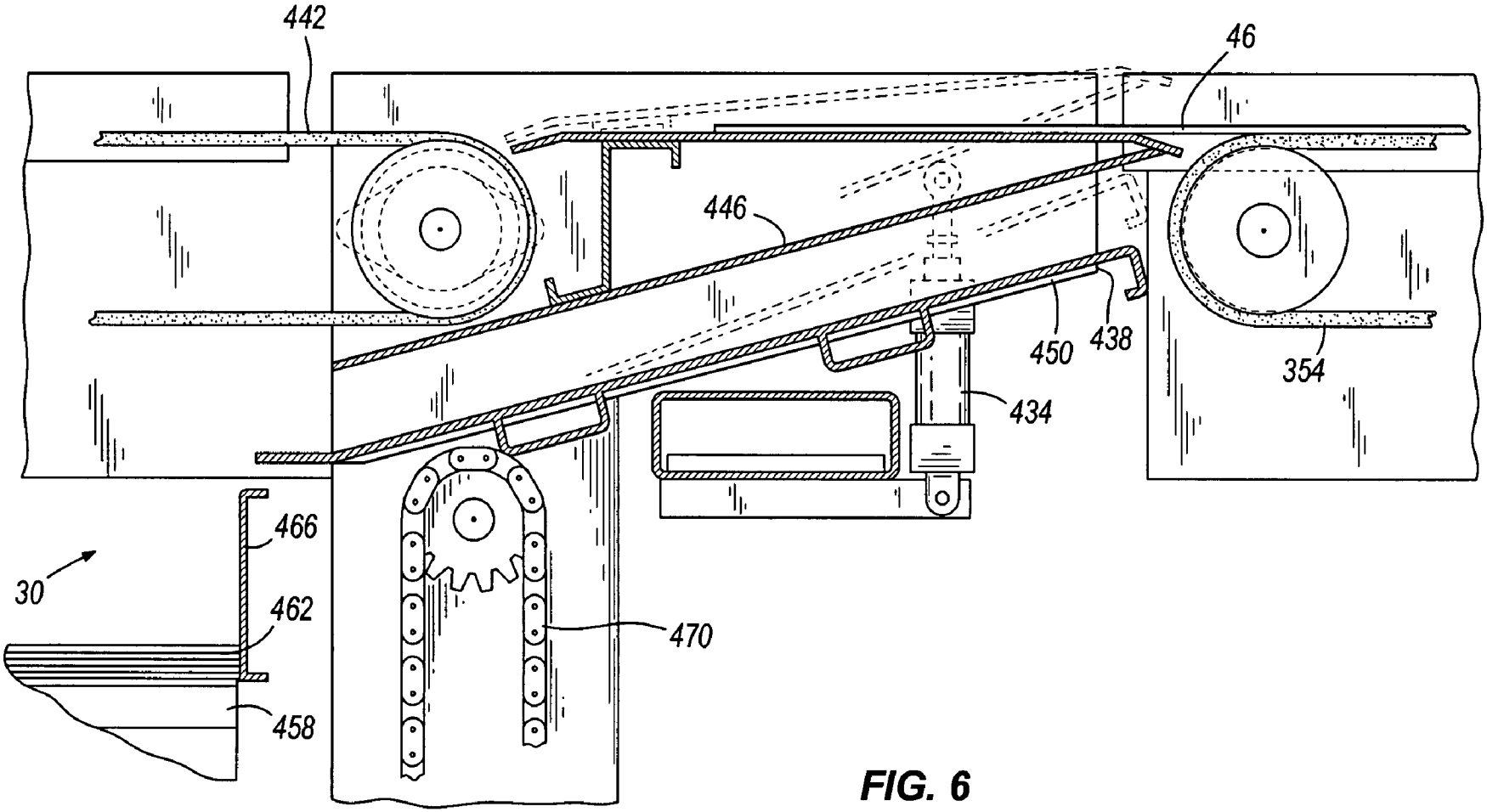
FIG. 6 is an enlarged side view of a separator sheet being directed toward a first storage assembly of the separator sheet handling assembly of FIG. 1.
Figure 7:
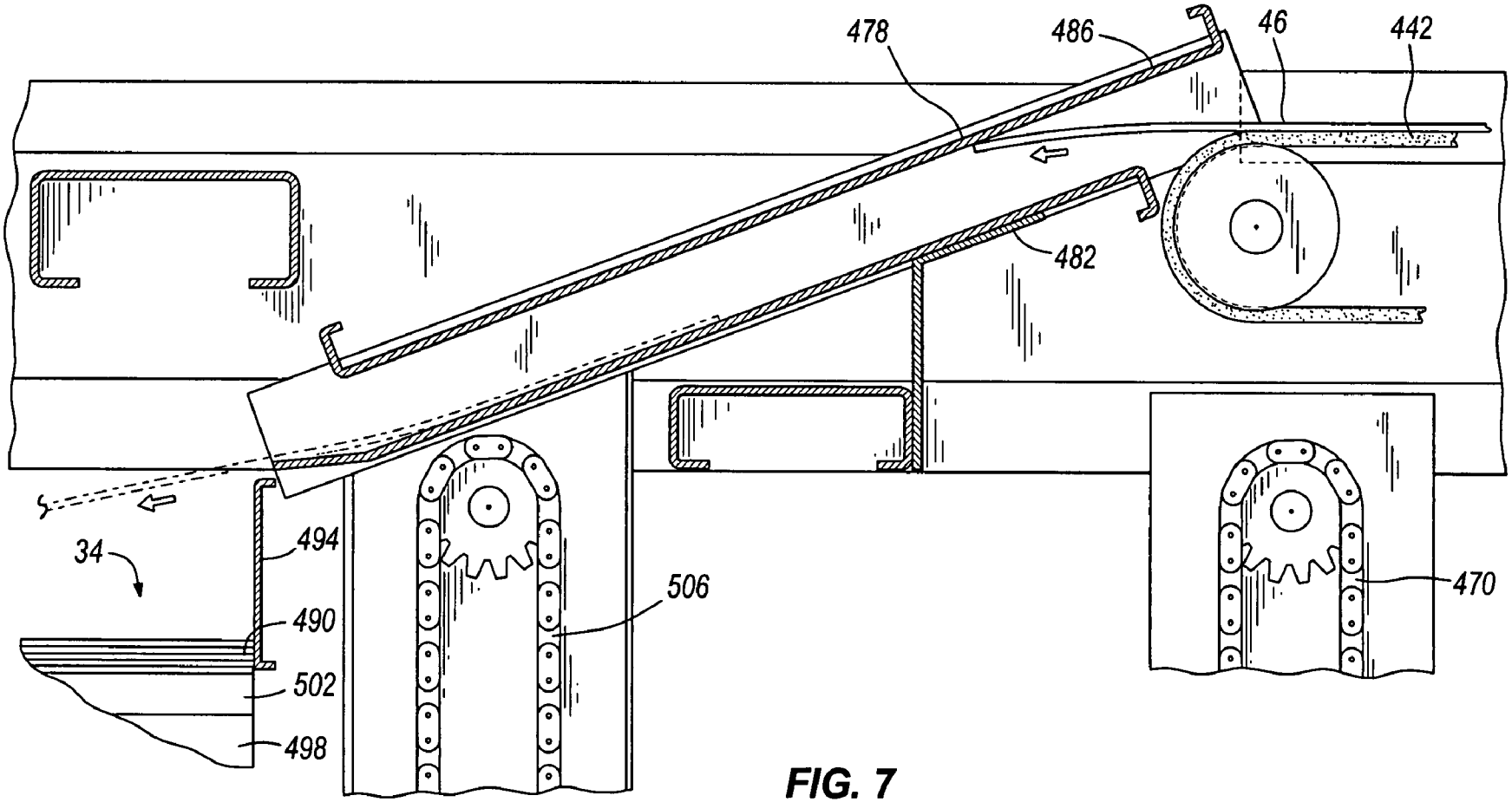
FIG. 7 is an enlarged side view of a separator sheet being directed toward a second storage assembly of the separator sheet handling assembly of FIG. 1.

From the test assembly 26, the separator sheet 46 is delivered either to the first storage assembly 30 or the second storage assembly 34 by the second endless belt 354, illustrated in FIGS. 6 and 7. However, the sheet 46 may not be required to be transported to either of the first or second storage assemblies 30, 34 after passing through the test assembly 26. Rather, depending on the result of visual inspection of the sheet 46 by the test assembly 26, the sheet may be routed to other machines for additional processing.

Depending on the characteristics of the separator sheet 46 (i.e., whether the sheet 46 "passes" or "fails" visual inspection), the PLC 170 sends out a signal that directs an actuator 434 to either expand or contract. The actuator 434 is connected to a directing guide 438 that moves up and down as the actuator 434 expands and contracts. In the assembly illustrated in FIG. 6, the actuator 434 is contracted such that the directing guide 438 is in a lowered position. When the directing guide 438 is in the lowered position, the separator sheet 46 passes over the directing guide 438 and moves from the second endless belt 354 onto a third endless belt 442 that transports the separator sheet 46 to the second storage assembly 34.

If the PLC 170 directs the actuator 434 to expand, the directing guide 438 moves into a raised position (see phantom lines in FIG. 6) such that the separator sheet 46 enters the directing guide 438 between an upper bracket 446 and a lower bracket 450. The separator sheet 46 continues through the directing guide 438 into the first storage assembly 30.

The first storage assembly 30 includes a lifting frame 454 (see FIG. 1) that is capable of supporting a pallet 458 (see FIG. 6) in a predetermined location. The separator sheet 46 enters the first storage assembly 30 and is positioned on top of a pile 462 of previously sorted separator sheets by guides 466. The lifting frame 454 is maneuvered up and down using chains 470 that are driven by sprockets positioned on opposite sides of a support structure 474 (FIG. 1). As the separator sheets 46 continue to stack up on the pallet 458, the lifting frame 454 is indexed downwardly until a desired number of separator sheets 46 have been stacked on to the pallet 458. The full pallet 458 may be directed from the first storage assembly 30 via a conveyor (not shown).

The situation illustrated in FIG. 7 occurs when the actuator 434 is retracted and the separator sheet 46 is transported over the directing guide 438 onto the third endless belt 442. The third endless belt 442 transports the separator sheet 46 between an upper bracket 478 and a lower bracket 482 on a receiving guide 486. The separator sheet 46 passes through the receiving guide 486 and is directed onto a pile of separator sheets 490 by guides 494. The second storage assembly 34 includes a lifting frame 498 that is adapted to support a pallet 502. Chains 506 move the lifting frame 498 up and down. Sprockets positioned on opposite sides of a support structure 510 support the chains 506. The lifting frame 498 indexes downwardly as the separator sheets 46 are stacked onto the pallet 502. Once the pallet 502 is stacked full of separator sheets 46, the pallet 502 can either be removed directly or transported via a conveyor (not shown) to another location.

The receiving guide 486 is different from the directing guide 438 in that the receiving guide 486 is not adjustable. As stated previously, the separate sheet handling assembly 10 can include additional storage assemblies (not shown). It should be apparent that the separator sheets 46 need to be directed into one of the storage assemblies 30, 34. The separator sheets 46 will be directed into the storage assembly 34 located on the end of the separator sheet handling assembly 10 if the separator sheet 46 has not been previously directed into another storage assembly 30. Therefore, a non-adjustable receiving guide 486 should be located before the final storage assembly 34.

In one embodiment, the separator sheet handling assembly 10 includes additional storage assemblies (beyond the first and second storage assemblies 30 and 34) for receiving separator sheets 46. For example, clean and undamaged separator sheets 46 are transported to the first storage assembly 30, dirty but undamaged sheets 46 would be transported into the second storage assembly 34 and damaged sheets would be transported into a third storage assembly (not shown).

In one form of the invention, the storage assemblies 30, 34 each include squaring fences (not shown). The squaring fences organize the stack of separator sheets 42 into a neat pile as the sheets 46 are inserted into the respective storage assemblies 30, 34. The squaring fences can be any configuration commonly known in the art and may continuously or periodically square the stacks of separator sheets as the respective lifting frames 454, 498 index the pallets 458, 502 downward.

In another embodiment of present invention the second storage assembly 34 does not include a lifting frame 498. Instead, the second storage assembly is located adjacent to the frame of separator sheet handling assembly 10 such that sheets 46 which are not delivered to the first storage assembly 30 are delivered off of an end of the separator sheet handling assembly 10 into a receptacle (e.g., a trash bin).

The constructions and aspects described above and illustrated in the drawings are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. Various features and advantages of the invention are set forth in the following claims.

What is claimed is:

1. A separator sheet handling assembly for sorting a stack of separator sheets into different locations depending on their characteristics, said separator sheet handling assembly comprising:

a feed assembly adapted to consecutively engage a separator sheet positioned at a top of a stack of separator sheets;

a test assembly adapted to determine a characteristic of the separator sheet, the test assembly including, a source of light to illuminate at least a portion of a surface of the separator sheet, and a vision inspection system to record at least one discrete image of the illuminated surface of the separator sheet and apply at least one test to the discrete image to determine the characteristic of the separator sheet; and a storage assembly for receiving designated separator sheets.

2. The separator sheet handling assembly of claim 1 wherein the vision inspection system includes a camera positioned below a bottom surface of the separator sheet and the source of light is positioned to illuminate the bottom surface of the separator sheet.

3. The separator sheet handling assembly of claim 2, and further comprising a translucent background sheet positioned opposite the camera wherein the separator sheet is positioned between the background sheet and the camera, and a background source of light to provide background lighting to the separator sheet, the background source of light positioned above the background sheet.

4. The separator sheet handling assembly of claim 1 wherein the vision inspection system includes a camera positioned above a top surface of the separator sheet and the source of light is positioned to illuminate the top surface of the separator sheet.

5. The separator sheet handling assembly of claim 4, and further comprising a translucent background sheet positioned opposite the camera wherein the separator sheet is positioned between the background sheet and the camera, a background source of light to provide background lighting to the separator sheet, the background source of light positioned below the background sheet.

6. The separator sheet handling assembly of claim 1 wherein the vision inspection system subdivides each discrete image into multiple regions and includes at least one sensor corresponding to each region of the discrete image.

7. The separator sheet handling assembly of claim 6 wherein each sensor includes at least one threshold value that controls sensitivity of the respective sensor in determining a visual characteristic of the separator sheet appropriate to the sensor.

8. The separator sheet handling assembly of claim 7, and further comprising a sensitivity adjustment mechanism wherein the sensitivity adjustment mechanism controls the at least one threshold value of the sensor in a particular region separately from the at least one threshold value of the sensors in other regions.

9. The separator sheet handling assembly of claim 8 wherein the sensitivity adjustment mechanism effectively deactivates specific sensors in known regions of the discrete image.

10. The separator sheet handling assembly of claim 8 wherein the at least one sensor of each region searches within the region for areas of differing color or shade from a mean color or shade of the region and compares size of areas and extent of differing color or shade to the at least one threshold value to determine if the areas are defects in the separator sheet.

11. The separator sheet handling system of claim 7 wherein the vision inspection system performs multiple searches within each region with different threshold values of size of areas and extent of differing color and shade from a mean color or shade of the region to determine if the areas are defects in the separator sheet.

12. The separator sheet handling system of claim 7 wherein the vision inspection system compares mean color or shade of each region, minimum color or shade of each region, and maximum color or shade of each region with the at least one threshold value for the region to determine if there are defects in the separator sheet.

13. The separator sheet handling assembly of claim 7 wherein the vision inspection system quantifies straightness of edge regions of the discrete image and compares mean peak straightness values of the edge regions to the threshold values to determine if there are defects in the edge regions of the separator sheet.

14. The separator sheet handling assembly of claim 1 wherein the vision inspection system analyzes results of the tests applied to the discrete image for at least one pattern purposefully printed on the illuminated surface of the separator sheet.

15. The separator sheet handling assembly of claim 1 wherein the characteristic of the separator sheet is a defect.

16. The separator sheet handling assembly of claim 1, and further comprising a sheet cleaning assembly for cleaning designated separator sheets based upon at least one characteristic of the separator sheet.

17. The separator sheet handling system of claim 1, and further comprising a second storage assembly for receiving the remaining separator sheets.

18. A test assembly adapted to determine a characteristic of a separator sheet, the test assembly comprising:

a first test sub-assembly positioned above the separator sheet to monitor a first, upwardly oriented surface of the separator sheet for a first characteristic; and a second test sub-assembly positioned below the separator sheet to monitor a second, downwardly oriented surface opposite the first surface of the separator sheet for a second characteristic, wherein one of the first and second test sub-assemblies is movable relative to the other of the first and the second test sub-assemblies.

19. The test assembly of claim 18 wherein the first test sub-assembly further comprises: a plurality of light sources directed at the first surface of the separator sheet;

and a camera to record at least one discrete image of the first surface of the separator sheet.

20. The test assembly of claim 19 wherein the first test sub-assembly further comprises: a translucent background sheet positioned opposite the camera wherein the separator sheet is positioned between the background sheet and the camera; and a background source of light to provide background lighting to the separator sheet, the background source of light directed at the second surface of the separator sheet.

21. The test assembly of claim 18 wherein the second test sub-assembly further comprises: a plurality of light sources directed at the second surface of the separator sheet; and a camera to record at least one discrete image of the second surface of the separator sheet.

22. The test assembly of claim 21 wherein the second test sub-assembly further comprises: a translucent background sheet positioned opposite the camera wherein the separator sheet is positioned between the background sheet and the camera; and a background source of light to provide background lighting to the separator sheet, the background source of light directed at the first surface of the separator sheet.

23. The test assembly of claim 18, and further comprising an actuation assembly to pivot the second test sub-assembly relative to the first test sub-assembly.

24. The test assembly of claim 18, and further comprising a vision inspection system interconnected with the first test sub-assembly and the second test sub-assembly, wherein the vision inspection system analyzes discrete images of the surfaces of the separator sheet received from the first test sub-assembly and the second test sub-assembly.

25. The test assembly of claim 24 wherein the vision inspection system includes a plurality of sensors to analyze the discrete images and determine the first and second characteristics of the separator sheet.

26. The test assembly of claim 25 wherein at least one of the characteristics is a defect characteristic.

27. The test assembly of claim 25 wherein at least one sensor is an edge sensor to scan the discrete images and determine an edge characteristic of the separator sheet.

28. The test assembly of claim 25 wherein at least one sensor is a blob sensor to scan the discrete images and determine the first characteristic or the second characteristic of the separator sheet.

29. The test assembly of claim 25 wherein each sensor outputs a pass/fail result determined by comparison of one or more quantitative results with threshold values configured into the sensors.

30. The test assembly of claim 25 wherein sensitivity of a particular sensor is controlled separately from the sensitivity of other sensors.

31. The test assembly of claim 25 wherein specific sensors are effectively deactivated in specific regions of the discrete images.

32. The test assembly of claim 25 wherein each discrete image is subdivided into multiple regions and the vision inspection system assigns each region a corresponding value based upon a characteristic in the region.

33. The test assembly of claim 32 wherein the vision inspection system defines a range of acceptable values for each region.

34. A method of using a test assembly to test a separator sheet for a characteristic, the method comprising:

providing a test assembly that includes a source of light and a vision inspection system illuminating at least a portion of a surface of the separator sheet with the source of light;

recording a discrete image of the illuminated surface of the separator sheet with the vision inspection system;

subdividing the discrete image into multiple regions with the vision inspection system and testing the discrete image with the vision inspection system to determine the characteristic of the separator sheet.

35. The method of claim 34 wherein testing the discrete image further comprises comparing a value for each region with a threshold value for each region to determine a characteristic of the separator sheet.

36. The method of claim 35, and further comprising defining a range of acceptable values for each region.

37. The method of claim 35, and further comprising separately controlling sensitivities for the regions.

38. The method of claim 34 wherein the testing the discrete image further comprises scanning the image to determine if an edge characteristic exists on the separator sheet.

39. The method of claim 34 wherein the testing the discrete image further comprises scanning the image to determine if the characteristic exists on the illuminated surface of the separator sheet.

* * * * *